US008463170B2

(12) United States Patent
Nanjo

(10) Patent No.: US 8,463,170 B2
(45) Date of Patent: Jun. 11, 2013

(54) IMAGE FORMING APPARATUS

(75) Inventor: Yuzuru Nanjo, Osaka (JP)

(73) Assignee: Kyocera Mita Corporation (JP)

( * ) Notice: Subject to any disclaimer, the term of this patent is extended or adjusted under 35 U.S.C. 154(b) by 467 days.

(21) Appl. No.: 12/582,815

(22) Filed: Oct. 21, 2009

(65) Prior Publication Data

US 2010/0104334 A1 Apr. 29, 2010

(30) Foreign Application Priority Data

Oct. 28, 2008 (JP) ..... 2008-276677

(51) Int. Cl.
*G03G 15/20* (2006.01)

(52) U.S. Cl.
USPC ..... 399/334; 399/67; 219/216

(58) Field of Classification Search
USPC ..... 399/67, 333, 334; 219/619
See application file for complete search history.

(56) References Cited

U.S. PATENT DOCUMENTS

| | | | | |
|---|---|---|---|---|
| RE36,962 | E | 11/2000 | Higashi et al. | |
| 7,835,680 | B2 * | 11/2010 | Nanjo et al. | 399/329 |
| 7,890,042 | B2 * | 2/2011 | Ishida et al. | 399/329 |
| 7,995,958 | B2 * | 8/2011 | Gon et al. | 399/332 |
| 8,078,072 | B2 * | 12/2011 | Nanjo et al. | 399/67 |
| 8,175,509 | B2 * | 5/2012 | Gon | 399/330 |
| 2007/0014599 | A1 * | 1/2007 | Yasuda et al. | 399/328 |
| 2007/0170172 | A1 | 7/2007 | Otsuka et al. | |
| 2009/0245902 | A1 * | 10/2009 | Gon et al. | 399/331 |
| 2010/0028061 | A1 * | 2/2010 | Nanjo et al. | 399/328 |
| 2010/0046996 | A1 * | 2/2010 | Nanjo et al. | 399/330 |
| 2010/0272482 | A1 * | 10/2010 | Nanjo | 399/328 |
| 2010/0272483 | A1 * | 10/2010 | Nanjo | 399/331 |
| 2011/0217097 | A1 * | 9/2011 | Nanjo | 399/329 |

FOREIGN PATENT DOCUMENTS

| | | |
|---|---|---|
| JP | 2007-199332 | 8/2007 |

* cited by examiner

*Primary Examiner* — Walter L Lindsay, Jr.
*Assistant Examiner* — Benjamin Schmitt
(74) *Attorney, Agent, or Firm* — Gerald E. Hespos; Michael J. Porco; Matthew T. Hespos

(57) ABSTRACT

A fixing device of an image forming apparatus includes a magnetic core forming a magnetic path composed of a first path for induction-heating a specified area of a heating member and a second path for induction-heating only a smaller area as a reduction of the specified area and the magnetic field being composed of a common magnetic field region where both the first and the second paths pass and an uncommon magnetic field region where only the first path passes; and a magnetism adjusting member arranged at least over the uncommon magnetic field region and permitting the passage of magnetic fluxes propagating toward the heating member from the magnetic core in the uncommon magnetic field region when the magnetic path is switched to the first path while suppressing the passage of the magnetic fluxes in the uncommon magnetic field region when the magnetic path is switched to the second path.

12 Claims, 28 Drawing Sheets

RELATIONSHIP OF TOTAL AMOUNT OF HEAT GENERATED AND SHIELDING EFFECT

IMAGE FORMING APPARATUS

BACKGROUND OF THE INVENTION

1. Field of the Invention

The present invention relates to an image forming apparatus that has a fixing device for fixing unfixed toner to a sheet bearing a toner image by heating and melting it while the sheet is passed through a nip between a pair of heated rollers or between a heating belt and a roller.

2. Description of the Related Art

For image forming apparatuses such as copiers and printers, attention has been, in recent years, focused on belt methods enabling a smaller heat capacity to be set due to demands of shortening a warm-up time and saving power in a fixing device for fixing a toner image to a sheet and other demands. Attention has also been, in recent years, focused on an electromagnetic induction heating method (IH) having a possibility of quick heating and highly efficient heating, and a multitude of products combining electromagnetic induction heating and belt methods have been commercialized from the viewpoint of energy saving upon fixing a color image. In the case of combining a belt method and the electromagnetic induction heating, the arrangement of an electromagnetic induction device outside a belt is frequently employed (so-called external IH) due to easy layout of a coil and cooling and, further, due to a merit of being able to directly heat the belt.

In the above electromagnetic induction heating method, various technologies have been developed to prevent an excessive temperature increase in a sheet non-passage area in consideration of a sheet width (paper width) passed through the fixing device. Particularly, the following first and second technologies are known as size switching means in the external IH.

In the first technology, a magnetic member is divided into a plurality of pieces, which are arranged in a sheet width direction, and some of the magnetic member pieces are moved toward or away from an exciting coil in accordance with the size of a sheet to be passed (paper width). In this case, heating efficiency decreases by moving the magnetic member pieces away from the exciting coil in sheet non-passage areas, and the amount of heat generated is thought to be less than in an area corresponding to a sheet with a minimum paper width.

In the second technology, other conductive members are arranged outside a minimum paper width range in a heating roller and the positions thereof are switched between those inside and outside the extent of a magnetic field. According to the second technology, the conductive members are first located outside the extent of the magnetic field to heat the heating roller by electromagnetic induction. If the temperature of the heating roller rises to the vicinity of a Curie temperature, the conductive members are moved into the extent of the magnetic field, whereby magnetic fluxes are caused to leak from the heating roller outside the minimum paper width range to prevent excessive temperature increases.

In order to further increase productivity, the size switching means of the above first and second technologies need an effect of suppressing excessive temperature increases more than at present. For example, in order to increase the excessive temperature increase suppressing effect more than at present in the second technology, it is thought to be good to increase the area of the conductive members for shielding magnetism more than at present.

However, if the area of the conductive members is excessively increased, it becomes difficult to completely retract the conductive members from the extent of the magnetic field.

Even if most of the conductive members can be retracted out of the extent of the magnetic field, there is a possibility that the remaining parts adversely affect the magnetic field. Therefore, there is a limit in enlarging the area of the conductive members even in order to increase the excessive temperature increase suppressing effect.

SUMMARY OF THE INVENTION

An object of the present invention is to provide technology capable of increasing an excessive temperature increase suppressing effect outside a sheet passage area without excessively increasing the area of members for shielding magnetism and little likely to affect a magnetic field particularly in the case where magnetism needs not be shielded (in the case where a temperature increase is desired).

In order to accomplish the above object, one aspect of the present invention is directed to an image forming apparatus including an image forming station for forming a toner image and transferring the toner image to a sheet; and a fixing device including a heating member and a pressing member and fixing the toner image to the sheet by conveying the sheet while holding the sheet between the heating member and the pressing member. The fixing device includes a coil arranged along the outer surface of the heating member for generating a magnetic field; a magnetic core arranged at a side of the coil opposite to the heating member and forming a magnetic path together with the heating member, (the magnetic path being composed of a first path for induction-heating a specified area of the heating member and a second path for induction-heating only a smaller area as a reduction of the specified area and the magnetic field being composed of a common magnetic field region where both the first and the second paths pass and an uncommon magnetic field region where only the first path passes); a path switching member for switching the magnetic path between the first path and the second path; and a magnetic adjusting member arranged at least over the uncommon magnetic field region and permitting the passage of magnetic fluxes propagating toward the heating member from the magnetic core in the uncommon magnetic field region when the magnetic path is switched to the first path by the path switching member while suppressing the passage of the magnetic fluxes in the uncommon magnetic field region when the magnetic path is switched to the second path by the path switching member.

These and other objects, features and advantages of the present invention will become more apparent upon reading of the following detailed description along with the accompanied drawings.

DETAILED DESCRIPTION OF THE PREFERRED EMBODIMENTS

Hereinafter, embodiments of the present invention are described in detail with reference to the drawings.

Figure 1:
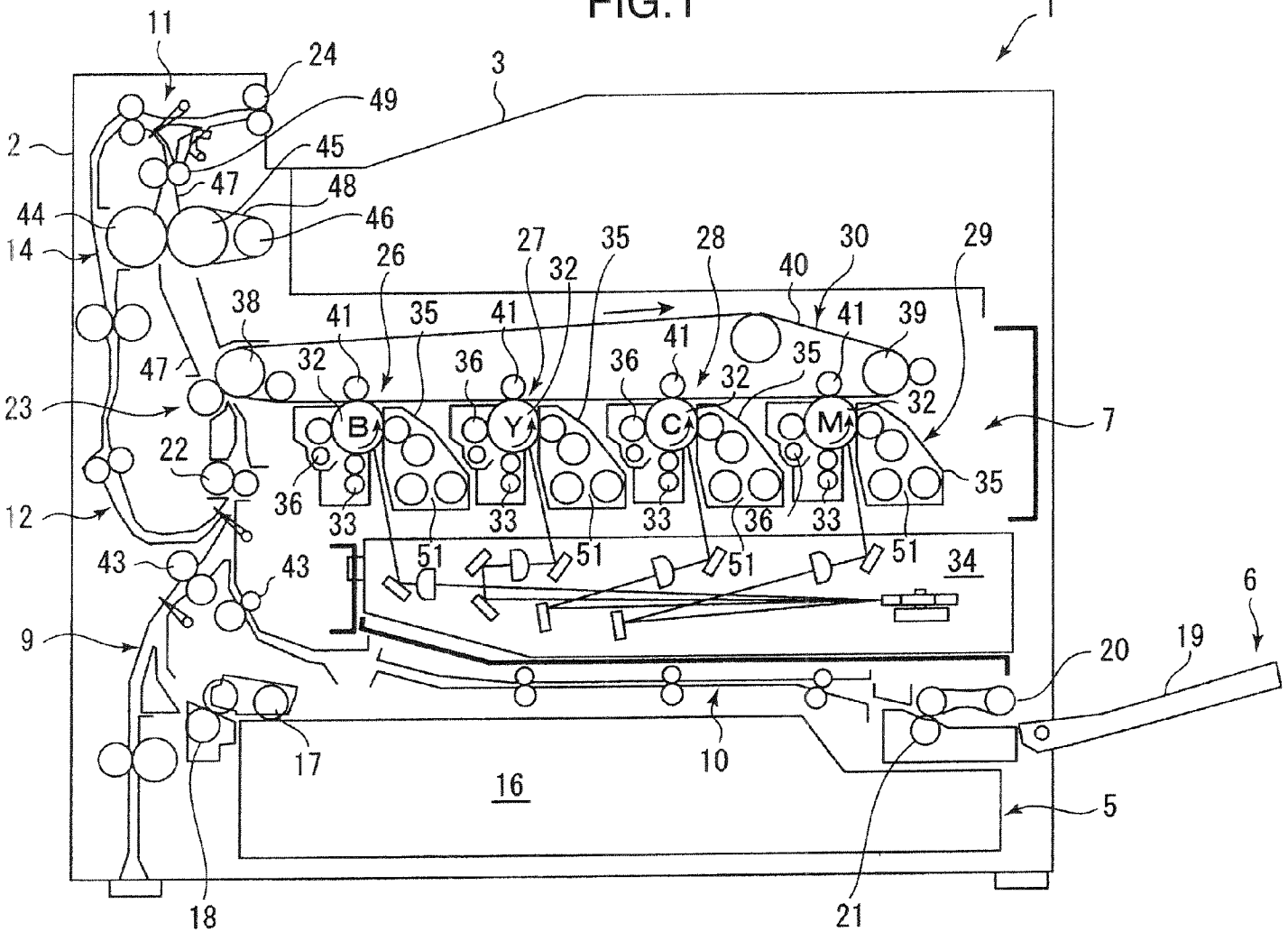
FIG. 1 is a schematic diagram showing the construction of a printer having a fixing device according to a first embodiment mounted therein.

FIG. 1 is a schematic diagram showing the construction of a printer 1 having a fixing device 14 according to a first embodiment mounted therein. The printer 1 is an example of an image forming apparatus for printing by transferring a toner image to the surface of a print medium such as a print sheet, for example, in accordance with externally inputted image information. The image forming apparatus having the fixing device 14 mounted therein may be a copier, a facsimile machine, a complex machine having these functions or the like besides the printer 1.

The printer 1 shown in FIG. 1 is, for example, a tandem color printer. This printer 1 is provided with an apparatus main body 2 in the form of a rectangular box for forming (printing) a color image on a sheet inside. A sheet discharge unit (discharge tray) 3 for discharging a sheet having a color image printed thereon is provided in a top part of the apparatus main body 2.

In the apparatus main body 2, a sheet cassette 5 for storing sheets is arranged at the bottom, a stack tray 6 for manually feeding a sheet is arranged in an intermediate part, and an image forming section 7 is arranged in an upper part. The image forming section 7 forms an image on a sheet based on image data such as characters and pictures transmitted from the outside of the apparatus.

A first conveyance path 9 for conveying a sheet dispensed from the sheet cassette 5 to the image forming section 7 is arranged in a left part of the apparatus main body 2 in FIG. 1, and a second conveyance path 10 for conveying a sheet dispensed from the stack tray 6 to the image forming section 7 is arranged from a right side to the left side. Further, the fixing device 14 for performing a fixing process to a sheet having an image formed thereon in the image forming section 7 and a third conveyance path 11 for conveying the sheet finished with the fixing process to the sheet discharge unit 3 are arranged in a left upper part in the apparatus main body 2.

The sheet cassette 5 enables the replenishment of sheets by being withdrawn toward the outside (e.g. toward front side in FIG. 1) of the apparatus main body 2. This sheet cassette 5 includes a storing portion 16, which can selectively store at least two types of sheets having different sizes in a sheet feeding direction. Sheets stored in the storing portion 16 are dispensed one by one toward the first conveyance path 9 by a feed roller 17 and separation rollers 18.

The stack tray 6 can be opened and closed relative to an outer surface of the apparatus main body 2, and sheets to be manually fed are placed one by one or a plurality of sheets are placed on a manual feeding portion 19. Sheets placed on the manual feeding portion 19 are dispensed one by one toward the second conveyance path 10 by a pickup roller 20 and separation rollers 21.

The first conveyance path 9 and the second conveyance path 10 join before registration rollers 22. A sheet fed to the registration rollers 22 temporarily waits on standby here and is conveyed toward a secondary transfer section 23 after a skew adjustment and a timing adjustment. A full color toner image on an intermediate transfer belt 40 is secondarily transferred to the conveyed sheet in the secondary transfer section 23. Thereafter, the sheet having the toner image fixed in the fixing device 14 is reversed in a fourth conveyance path 12 if necessary, so that a full color toner image is secondarily transferred also to the opposite side of the sheet in the secondary transfer section 23. After the toner image on the opposite side is fixed in the fixing device 14, the sheet is discharged to the sheet discharge unit 3 by discharge rollers 24 through the third conveyance path 11.

The image forming section 7 includes four image forming units 26 to 29 for forming toner images of black (B), yellow (Y), cyan (C) and magenta (M) and an intermediate transfer unit 30 for bearing the toner images of the respective colors formed in the image forming units 26 to 29 in a superimposed manner.

Each of the image forming units 26 to 29 includes a photosensitive drum 32, a charger 33 arranged to face the peripheral surface of the photosensitive drum 32, a laser scanning unit 34 arranged downstream of the charger 33 for emitting a laser beam to a specific position on the peripheral surface of the photosensitive drum 32, a developing unit 35 arranged downstream of a laser beam emission position from the laser scanning unit 34 to face the peripheral surface of the photosensitive drum 32 and a cleaning unit 36 arranged downstream of the developing unit 35 to face the peripheral surface of the photosensitive drum 32.

The photosensitive drum 32 of each of the image forming units 26 to 29 is rotated in a counterclockwise direction of FIG. 1 by an unillustrated drive motor. Black toner, yellow toner, cyan toner and magenta toner are respectively contained in toner boxes 51 of the developing units 35 of the respective image forming units 26 to 29.

The intermediate transfer unit 30 includes a rear roller (drive roller) 38 arranged at a position near the image forming unit 26, a front roller (driven roller) 39 arranged at a position near the image forming unit 29, an intermediate transfer belt 40 mounted on the rear roller 38 and the front roller 39 and four transfer rollers 41 arranged at positions downstream of the developing units 35 of the corresponding image forming units 26 to 29 such that they can be pressed into contact with the photosensitive drums 32 via the intermediate transfer belt 40.

In this intermediate transfer unit 30, the toner images of the respective colors are transferred in a superimposition manner on the intermediate transfer belt 40 at the positions of the transfer rollers 41 of the respective image forming units 26 to 29 and finally become a full color toner image.

The first conveyance path 9 conveys a sheet dispensed from the sheet cassette 5 toward the intermediate transfer unit 30 and includes a plurality of conveyor rollers 43 arranged at specified positions in the apparatus main body 2 and the registration rollers 22 arranged before the intermediate transfer unit 30 for timing an image forming operation and a sheet feeding operation in the image forming section 7.

The fixing device 14 fixes an unfixed toner image to a sheet by heating and pressing the sheet having the toner image transferred thereto in the image forming section 7. The fixing device 14 includes, for example, a pair of rollers having a pressing roller 44 and a fixing roller 45 of heating type. Out of these rollers, the pressing roller 44 includes, for example, a metallic core member and an elastic outer layer (e.g. silicon rubber) and the fixing roller 45 includes a metallic core member, an elastic outer layer (e.g. silicon sponge) and a mold releasing layer (e.g. PFA). Further, a heat roller 46 is disposed adjacent to the fixing roller 45, and a heating belt 48 is mounted on this heat roller 46 and the fixing roller 45. A detailed structure of the fixing device 14 is further described later.

Conveyance paths 47 are arranged upstream and downstream of the fixing device 14 in a sheet conveying direction. A sheet conveyed through the intermediate transfer unit 30 is introduced to a nip between the pressing roller 44 and the fixing roller 45 via the upstream conveyance path 47. The sheet having passed through between the pressing roller 44 and the fixing roller 45 is guided to the third conveyance path 11 via the downstream conveyance path 47.

The third conveyance path 11 conveys the sheet finished with the fixing process in the fixing device 14 to the sheet discharge unit 3. Thus, conveyer rollers 49 are arranged at a suitable position in the third conveyance path 11 and the above discharge rollers 24 are arranged at the exit of the third conveyance path 11.

First Embodiment

Next, the fixing device 14 of the first embodiment is described in detail.

Figure 2:
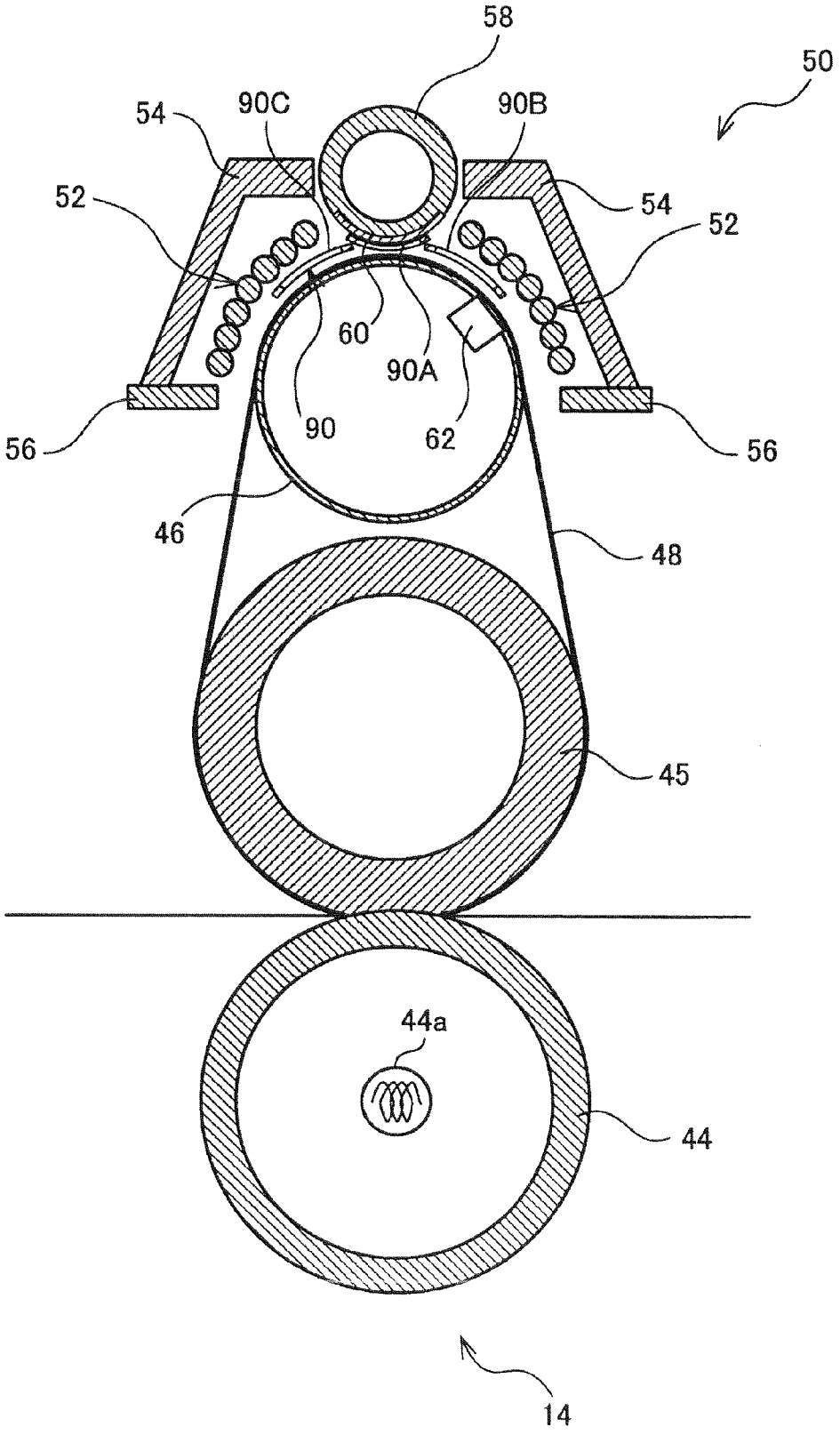
FIG. 2 is a vertical section showing a structure example of the fixing device according to the first embodiment.

FIG. 2 is a vertical section showing a structure example of the fixing device 14 of the first embodiment. In FIG. 2, the orientation of the fixing unit 14 is rotated counterclockwise by about 90° from an actually mounted state in the printer 1. Accordingly, the sheet conveying direction from lower side to upper side in FIG. 1 is from right side to left side in FIG. 2. If the apparatus main body 2 has a larger size (complex machine or the like), the fixing unit 14 may be actually mounted in the orientation shown in FIG. 2.

The fixing unit 14 includes the pressing roller 44, the fixing roller 45, the heat roller 46 and the heating belt 48 as described above. A sheet having a toner image transferred thereto is conveyed while being held between the pressing roller 44 and the heating belt 48. At this time, heat is given to the sheet from the heating belt 48 to fix the toner image to the sheet. Sheet passage areas W1, W2 and W3 to be brought into contact with sheets of a minimum size, a medium size and a maximum size, which can pass the fixing device 14, are set on the heating belt 48. Since the elastic layer of silicon sponge is formed on the outer layer of the fixing roller 45 as described above, a flat nip is formed between the heating belt 48 and the fixing roller 45.

A base member of the heating belt 48 is made of a ferromagnetic material (e.g. Ni), a thin elastic layer (e.g. silicon rubber) is formed on the outer surface of the base member, and the mold releasing layer (e.g. PFA) is formed on the outer surface of the elastic layer. In the case of providing the heating belt 48 with no heat generating function, the heating belt 48 may be a belt made of a resin such as PI. A core of the heat roller 46 is made of a magnetic metal (e.g. Fe, SUS) and a mold releasing layer (e.g. PFA) is formed on the outer surface of the core.

The pressing roller 44 is more specifically described. For example, Fe, Al or the like is used for the metallic core member of the pressing roller 44, a Si-rubber layer is formed on this core member and a fluororesin layer is formed on the outer surface of the Si-rubber layer. A halogen heater 44*a* may be, for example, provided inside the pressing roller 44.

The fixing unit 14 further includes an IH coil unit 50 at an outer side of the heat roller 46 and the heating belt 48 (not shown in FIG. 1). The IH coil unit 50 includes an induction heating coil 52, a pair of arch cores 54, a pair of side cores 56 and a center core 58.

[Coil]

In the example of FIG. 2, the induction heating coil 52 is arranged on a virtual arcuate surface extending along an arcuate outer surface for induction heating in arcuate parts of the heat roller 46 and the heating belt 48. Actually, an unillustrated resin bobbin (not shown) is arranged at the outer side of the heat roller 46 and the heating belt 48 and the induction heating coil 52 is wound around this bobbin. The unillustrated bobbin is formed to have a semicylindrical shape along the outer surface of the heat roller 46. The bobbin is preferably made of a heat resistant resin (e.g. PPS, PET, LCP).

[Magnetic Cores]

The center core 58 is located in the center in FIG. 2, and the arch cores 54 (first cores) and the side cores 56 (first cores) are arranged in pairs at the opposite sides of the center core 58. The arch cores 54 at the opposite sides are cores made of ferrite (magnetic cores) and formed to have arched cross sections symmetrical with each other, and the entire lengths thereof are longer than a winding area of the induction heating coil 52. The side cores 56 at the opposite sides are cores made of ferrite (magnetic cores) and having a block shape. The side cores 56 at the opposite sides are connected with one ends (bottom ends in FIG. 2) of the corresponding arch cores 54 and cover the outer side of the winding area of the induction heating coil 52.

Out of these, the arch cores 54 are arranged at a plurality of positions spaced part, for example, in a longitudinal direction of the heat roller 46. The side cores 56 are continuously arranged without being interrupted in the longitudinal direction of the heat roller 46, and the entire length thereof corresponds to the length of the winding area of the induction heating coil 52. The arrangement of these cores 54, 56 is determined, for example, in accordance with a magnetic flux density (magnetic field intensity) of the induction heating coil 52. Since the arch cores 54 are arranged at certain intervals, the side cores 56 compensate for a magnetic field focusing effect at positions where the arch cores 56 are absent to level out a magnetic flux density distribution (temperature difference) in the longitudinal direction.

An unillustrated core holder made of resin is, for example, provided at the outer side of the arch cores 54 and the side cores 56, and the arch cores 54 and the side cores 56 are supported by this holder. The core holder is also preferably made of a heat resistant resin (e.g. PPS, PET, LCP).

In the example of FIG. 2, a thermistor 62 is arranged inside the heat roller 46. The thermistor 62 can be arranged inside the heat roller 46 at a position where the amount of heat generated by induction heating is particularly large. Besides, an unillustrated thermostat may be arranged inside the heat roller 46 to improve safety in the event of an abnormal temperature increase.

[Center Core]

The center core 58 (second core) is, for example, a core made of ferrite and having a hollow cylindrical shape. Substantially similar to the heating roller 46, the center core 58 has a length corresponding to the maximum paper width of sheets. Although not shown in FIG. 2, the center core 58 is connected with an unillustrated driving mechanism and made rotatable about its longitudinal axis by this driving mechanism. The driving mechanism is further described later.

[Shielding Member]

Shielding members 60 are mounted on the center core 58 along its outer surface. Each shielding member 60 is in the form of a thin plate and entirely curved into an arcuate shape. The shielding members 60 may be, for example, embedded in the center core 58 as shown or may be bonded to the outer surface of the center core 58. The shielding members 60 can be bonded, for example, using a silicon adhesive. In any case, the shielding members 60 rotate together with the center core 58, thereby constituting a path switching member for switching a path (magnetic path) of a magnetic field generated by the induction heating coil 52. The switch of the magnetic path according to the rotation of the center core 58 is described later.

The material of the shielding members 60 is preferably nonmagnetic and good in electrical conductivity. For example, oxygen-free copper or the like is used. The shielding members 60 shield by generating opposite magnetic fields by induction currents (eddy currents) generated by the penetration of a magnetic field perpendicular to the surfaces of the shielding members 60 and canceling interlinkage fluxes (perpendicular penetrating magnetic field). Further, by using a good electrically conductive material, the generation of Joule heat by the induction currents is suppressed and the magnetic field can be efficiently shielded. In order to improve electrical conductivity, it is effective, for example, (1) to select a material with as small a specific resistance as possible and (2) to increase the thickness of the members. Specifically, it is preferable to set the thickness of the shielding members 60 to 0.5 mm or larger. In the first embodiment, the shielding members 60 having a thickness of 1 mm are used.

[Magnetism Adjusting Member]

In addition, in the IH coil unit 50, magnetism adjusting members 90 are fixedly arranged in a region spreading to the opposite lateral sides between the induction heating coil 52 and the heating belt 48 (heat roller 46) from a central position between the center core 58 and the heating belt 48 (heat roller 46). A clearance of such an appropriate size as to prevent interference with the rotation of the center core 58 is ensured between the center core 58 (shielding members 60) and the magnetism adjusting members 90.

Figure 3:
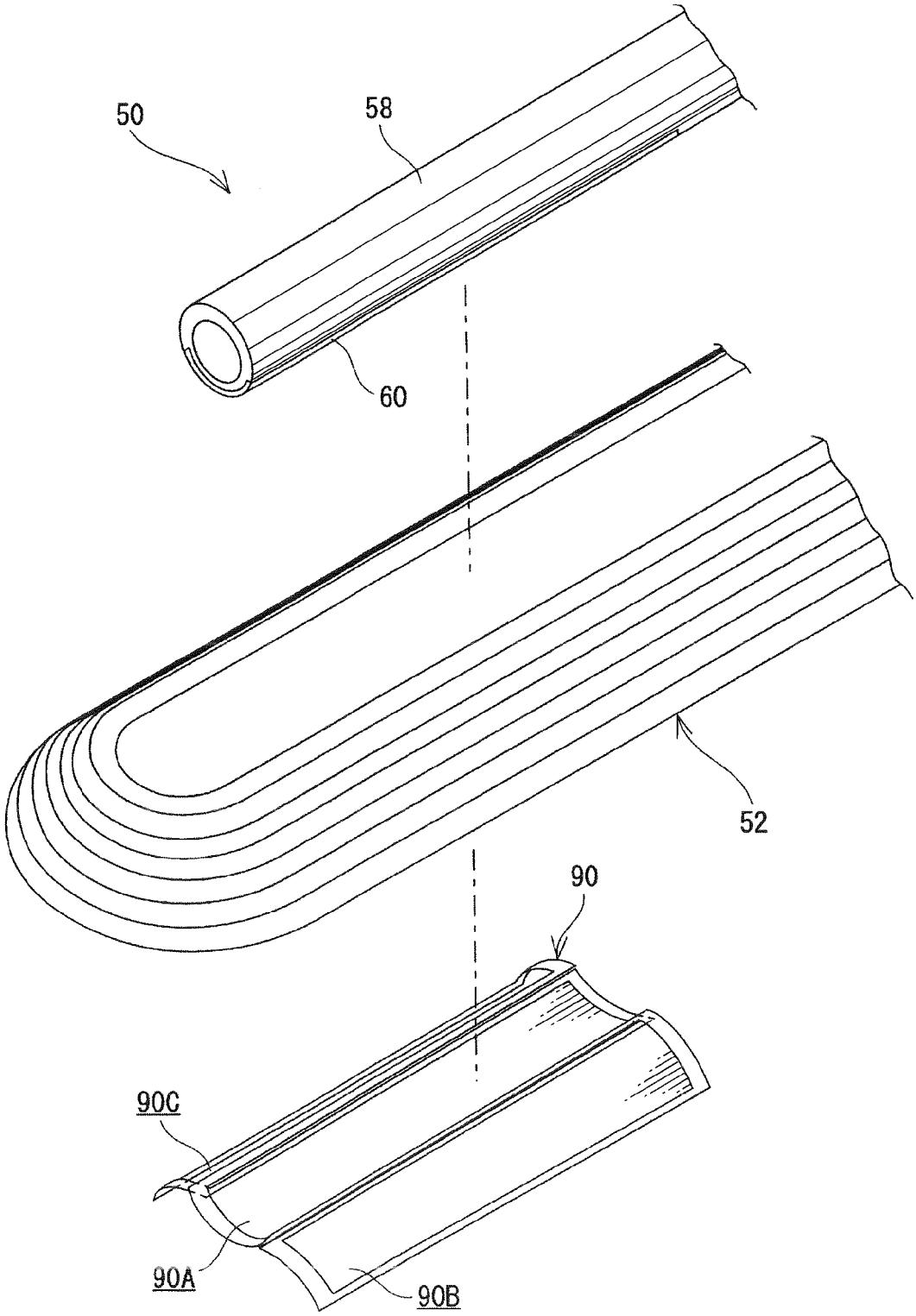
FIG. 3 is an exploded perspective view showing an arrangement relationship of a center core, a shielding member, an induction heating coil and a magnetism adjusting member.

FIG. 3 is an exploded perspective view showing an arrangement relationship of the center core 58, the shielding member 60, the induction heating coil 52 and the magnetism adjusting member 90. As described above, the entire lengths of the center core 58 and the heat roller 46 are longer than the maximum paper width and, accordingly, the winding area of the induction heating coil 52 spreads in such a range as to be able to cover the center core 58 over the entire length in the longitudinal direction of the center core 58.

On the other hand, the shielding members 60 are respectively arranged on the opposite end portions of the center core 58 in the longitudinal direction, and the magnetism adjusting members 90 are respectively arranged at the opposite end portions of the center core 58 (or the heat roller 46) in the longitudinal direction (only one end portion is shown in FIG. 3). The shielding members 60 and the magnetism adjusting members 90 are both arranged, for example, outside the minimum paper width range of sheets used in the printer 1.

[Structure Example of the Magnetism Adjusting Member]

Figure 4:
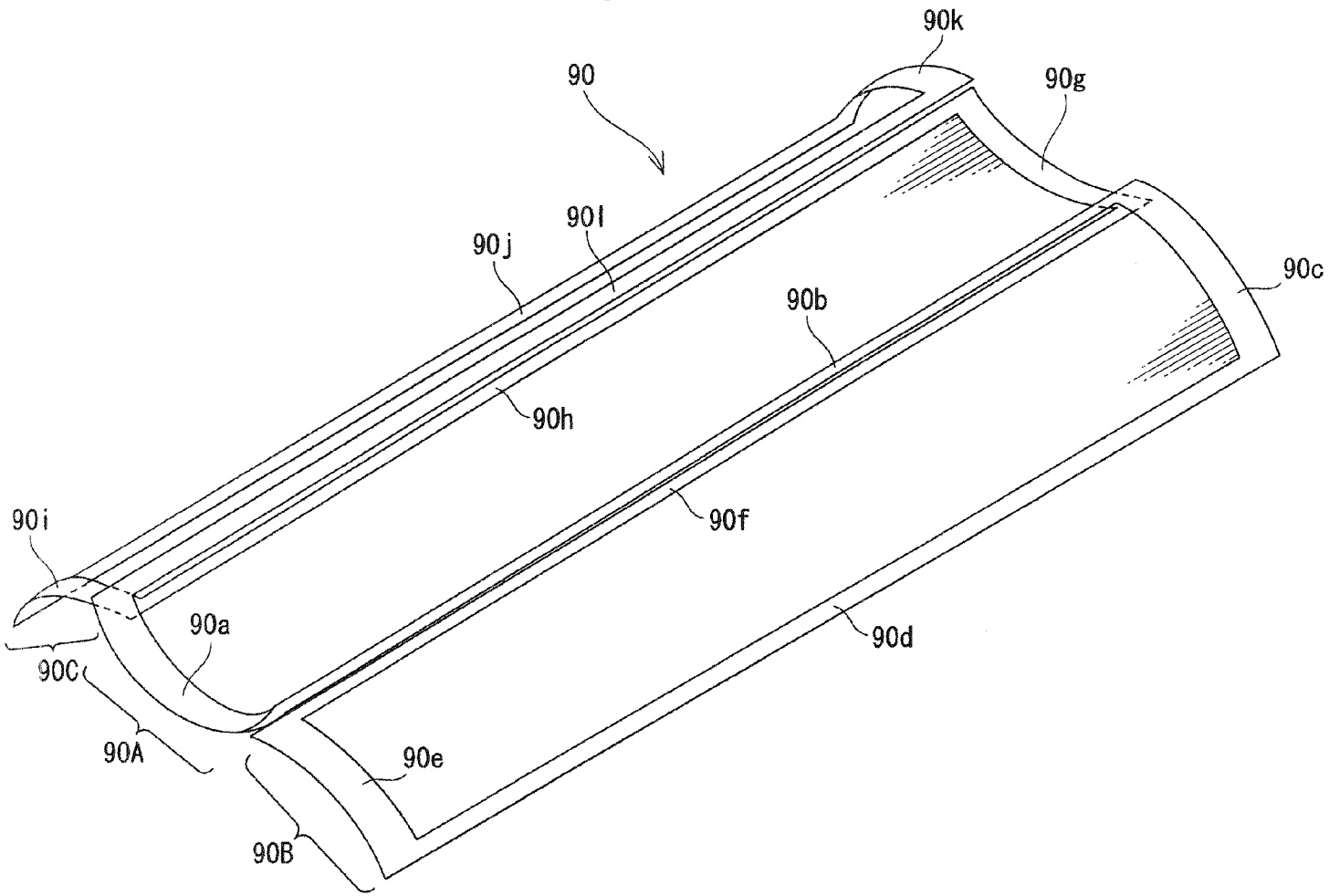
FIG. 4 is a perspective view showing a structure example of the magnetism adjusting member.

FIG. 4 is a perspective view showing a structure example of the magnetism adjusting member 90. The magnetism adjusting member 90 mainly includes three ring-shaped portions 90A, 90B and 90C, and all of these ring-shaped portions 90A, 90B and 90C have rectangular ring shapes. The three ring-shaped portions 90A, 90B and 90C are not independent rings, but connected with each other, whereby the entire magnetism adjusting member 90 has a continuous and endless structure. The structure of the magnetism adjusting member 90 is described below.

The magnetism adjusting member 90 includes three shorter-side portions 90*a*, 90*e* and 90*i* at one end and three shorter-side portions 90*g*, 90*c* and 90*k* at the other end in a longitudinal direction thereof. The magnetism adjusting member 90 also includes one longer-side portion 90*d* at one end and one longer-side portion 90*j* at the other end in a width direction thereof (direction orthogonal to the longitudinal direction).

Further, the magnetism adjusting member 90 includes two longer-side portions 90*b*, 90*f* between the central ring-shaped portion 90A and the adjacent ring-shaped portion 90B and two longer-side portions 90*l*, 90*h* between the central ring-shaped portion 90A and the other adjacent ring-shaped portion 90C at positions near the widthwise center thereof.

[Central Ring-Shaped Portion]

The central ring-shaped portion 90A includes the two shorter-side portions 90*a*, 90*g* paired in the longitudinal direction and these shorter-side portions 90*a*, 90*g* are not connected to each other in the ring-shaped portion 90A. In other words, out of the central ring-shaped portion 90A, the longer-side portions 90*b*, 90*l* respectively have one ends thereof connected with the opposite ends of one shorter-side portion 90*a* and extend in the longitudinal direction, wherein the other end of one longer-side portion 90*b* is connected with the shorter-side portion 90*c* of the adjacent ring-shaped portion 90B and the other end of the other longer-side portion 90*l* is connected with the ring-shaped portion 90*k* of the other adjacent ring-shaped portion 90C.

Further, out of the central ring-shaped portion 90A, the longer-side portions 90*f*, 90*h* respectively have one ends thereof connected with the opposite ends of the other shorter-side portion 90*c* and extend in the longitudinal direction, wherein the other end of one longer-side portion 90*f* is connected with the shorter-side portion 90*e* of the adjacent ring-shaped portion 90B and the other end of the other longer-side portion 90*h* is connected with the shorter-side portion 90*i* of the other adjacent ring-shaped portion 90C. Accordingly, the shorter-side portions 90*a*, 90*g* paired in the ring-shaped portion 90A are not connected to each other via the longer-side portions 90*b*, 90*f* or the longer-side portions 90*l*, 90*h* likewise paired in the ring-shaped portion 90A.

[Ring-Shaped Portions at the Opposite Sides]

Out of the two ring-shaped portions 90B, 90C adjacent to and located at the opposite sides of the central ring-shaped portion 90A, the two shorter-side portions 90*c*, 90*e* paired in the longitudinal direction are connected via the outer longer-side portion 90*d* in one ring-shaped portion 90B, wherein one shorter-side portion 90*e* is connected to the shorter-side portion 90*g* of the central ring-shaped portion 90A via one longer-side portion 90*f* near the center. Further, the other shorter-side portion 90*c* is connected to the shorter-side portion 90*a* of the central ring-shaped portion 90A via the other longer-side portion 90*b* near the center.

Similarly, in the other ring-shaped portion 90C, the two shorter-side portions 90*i*, 90*k* paired in the longitudinal direction are connected via the longer-side portion 90*j* at the outer side, wherein one shorter-side portion 90*i* is connected to the shorter-side portion 90*g* of the central ring-shaped portion 90A via one longer-side portion 90*h* near the center. Further, the other shorter-side portion 90*k* is connected to the shorter-side portion 90*a* of the central ring-shaped portion 90A via the other longer-side portion 90*l* near the center.

[Overall Structure]

From the above connection relationship, the magnetism adjusting member 90 has an endless structure as a whole by successively and continuously connecting one end of the shorter-side portion 90*a* of the central ring-shaped portion 90A with the longer-side portion 90*b*, the shorter-side portion 90*c*, the longer-side portion 90*d*, the shorter-side portion 90*e*, the longer-side portion 90*f*, the shorter-side portion 90*g*, the longer-side portion 90*h*, the shorter-side portion 90*i*, the longer-side portion 90*j*, the shorter-side portion 90*k* and the longer-side portion 90*l*, for example, with the shorter-side portion 90*a* as a starting point. It is preferable that any of the shorter-side portions 90*a*, 90*c*, 90*e*, 90*g*, 90*i* and 90*k* and the longer-side portions 90*b*, 90*d*, 90*f*, 90*j* and 90*l* is made of a wire material (may be a narrow plate material) of a nonmagnetic metal and that insulation coating is applied to the outer surfaces thereof.

The two shorter-side portions 90*a*, 90*g* of the central ring-shaped portion 90A are arcuately curved along the outer surface shape of the center core 58, and the shorter-side portions 90*c*, 90*e*, 90*i* and 90*k* of the ring-shaped portions 90B, 90C at the opposite sides are arcuately curved along the inner peripheral surface shape of the induction heating coil 52. In this way, the interference of the magnetism adjusting members 90 with the center core 58 and the induction heating coil 52 can be satisfactorily avoided in a mounted state of the magnetism adjusting members 90.

[Functions of the Magnetism Adjusting Member]

Figure 5A:
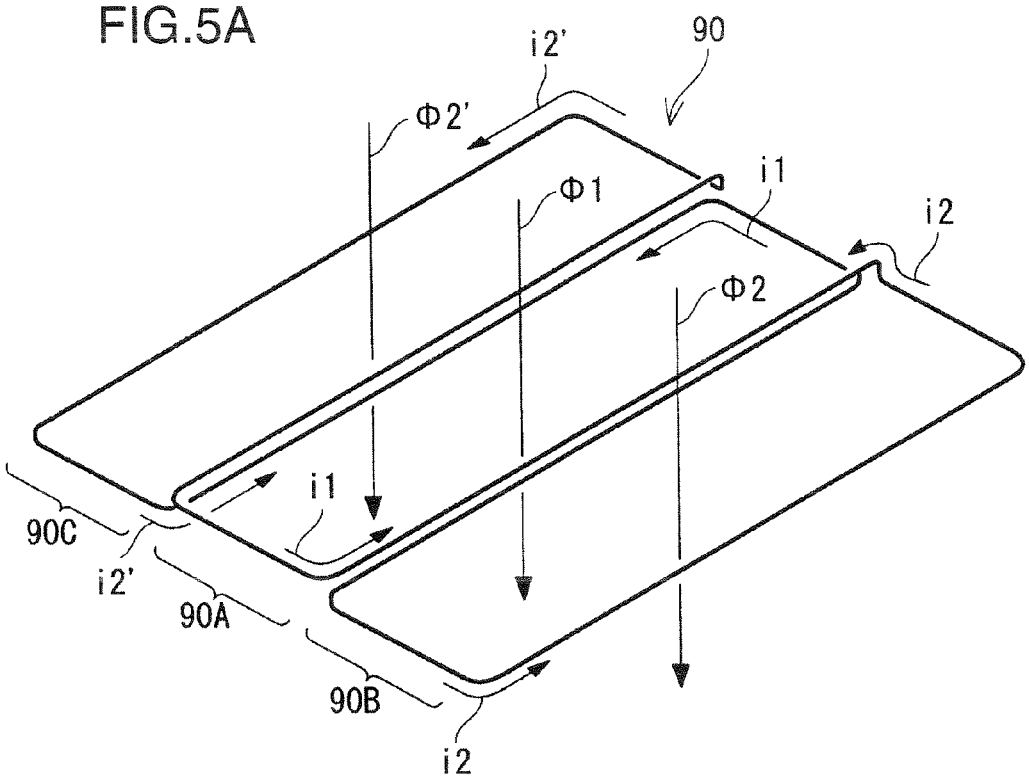
FIGS. 5A and 5B are model diagrams showing a function of the magnetism adjusting member.
Figure 5B:
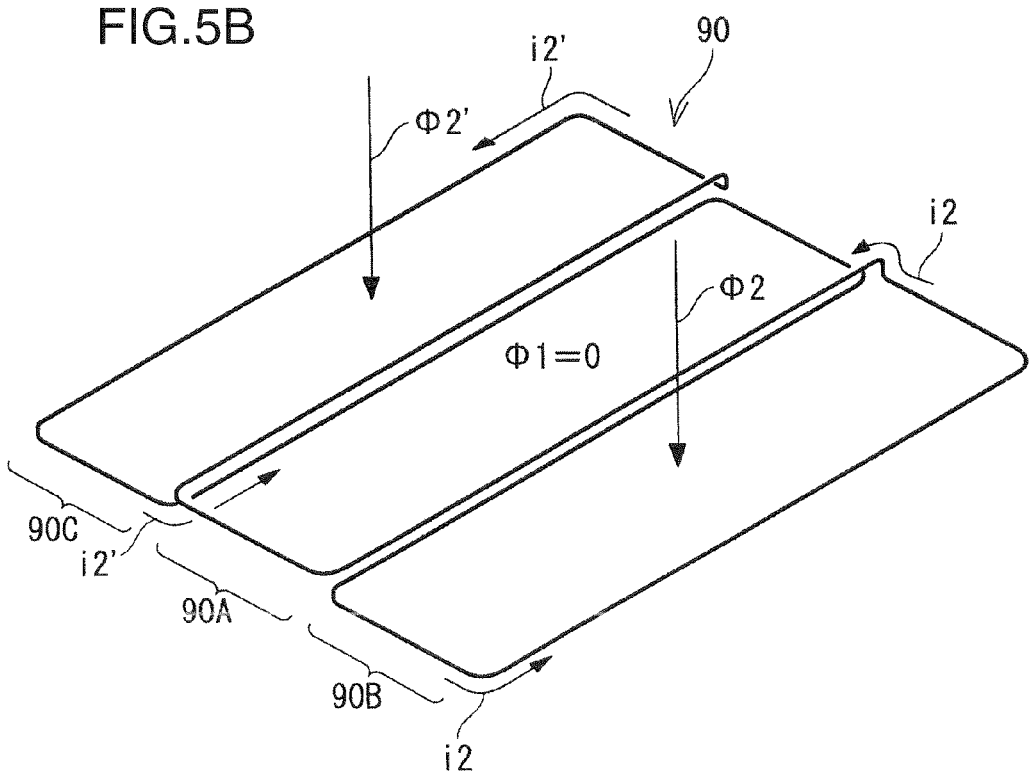

FIGS. 5A and 5B are diagrams of a model showing a function of the magnetism adjusting member. Although the magnetism adjusting member 90 is simplified and shown as a wire model in FIG. 5, the connection relationship of the respective ring-shaped portions 90A, 90B and 90C is the same as in FIG. 4. In FIG. 5, the respective shorter-side portions 90*a*, 90*g*, 90*c*, 90*e*, 90*i* and 90*k* are shown to be linear for the sake of convenience.

[At the Time of Passage of Magnetic Fluxes]

If the magnetism adjusting member 90 is thought as a wire model as shown in FIG. 5A, the structure thereof can be thought such that the three ring-shaped portions 90A, 90B and 90C are formed as described above by twisting one large ring (annular body) in opposite directions at two positions.

If a magnetic flux Φ1 enters the central ring-shaped portion 90A (i.e. ring surface) in such a magnetism adjusting member 90, a current i1 trying to cancel it out (induction current for generating a canceling magnetic flux of a direction opposite to the magnetic flux Φ1) is generated in this ring-shaped portion 90A. Similarly, when magnetic fluxes Φ2, Φ2' enter the two adjacent ring-shaped portions 90B, 90C (ring surfaces) at the opposite sides (left and right sides), currents i2, i2' (induction currents for generating canceling magnetic fluxes of a direction opposite to the magnetic fluxes Φ2, Φ2') are respectively generated also in the ring-shaped portions 90B, 90C.

At this time, since the currents i2, i2' respectively generated in the ring-shaped portions 90B, 90C at the opposite sides are of the same direction, but the current i1 generated in the central ring-shaped portion 90A is of the opposite direction, currents (summation) flowing in the magnetism adjusting member 90 are zero when the following conditional expression (1) is satisfied.

$$|i1|=|i2|+|i2'| \quad (1)$$

It should be noted that |i1|, |i2| and |i2|' respectively denote absolute values of the currents (magnetomotive forces).

Accordingly, when the above conditional expression (1) is satisfied, all the magnetic fluxes Φ1, Φ2 and Φ2' can directly pass through the respective ring-shaped portions 90A, 90B and 90C without being particularly canceled out.

[At the Time of Shielding Magnetic Fluxes]

Next, a case is thought where only the magnetic flux Φ1 entering the central ring-shaped portion 90A is removed from the above state as shown in FIG. 5B. In this case, no current is generated in the central ring-shaped portion 90A (i1=0) and the currents flowing in the magnetism adjusting member 90 are only the right-hand side (|i2|+|i2'|) of the conditional expression (1).

Accordingly, in the case of removing the magnetic flux 11 of the central ring-shaped portion 90A, the magnetic fluxes Φ2, Φ2' are canceled out by the currents i2, i2' in the ring-shaped portions 90B, 90C at the opposite sides, with the result that the magnetic fluxes Φ2, Φ2' are respectively shielded by the ring-shaped portions 90B, 90C.

SUMMARY

From the above, the following conclusion is reached for the magnetism adjusting member 90.

(1) If the relational expression of Φ1=Φ2+Φ2' is satisfied, the currents generated in the magnetism adjusting member 90 become 0 and the magnetism adjusting member 90 permits the passage of all the magnetic fluxes Φ1, Φ2 and Φ2'. In this case, the magnetism adjusting member 90 does not affect the magnetic field at all.

(2) If the state of Φ1=0 is set in the above state (1), the currents i2+i2' flow in the magnetism adjusting member 90, wherefore the magnetism adjusting member 90 shields the magnetic fluxes Φ2, Φ2' without permitting the passage thereof. In this case, the magnetism adjusting member 90 exhibits a magnetic shielding effect within the ranges of the ring-shaped portions 90B, 90C.

In view of the above, the structure and the arrangement satisfying the following relational expression (2) for the magnetic flux Φ1 (Wb) entering the central ring-shaped portion 90A of the magnetism adjusting member 90 and the magnetic fluxes Φ2, Φ2' (Wb) entering the two adjacent ring-shaped portions 90B, 90C at the opposite sides are employed in the fixing device 14 of the first embodiment.

$$\Phi 1=\Phi 2+\Phi 2' \quad (2)$$

Figure 6A:
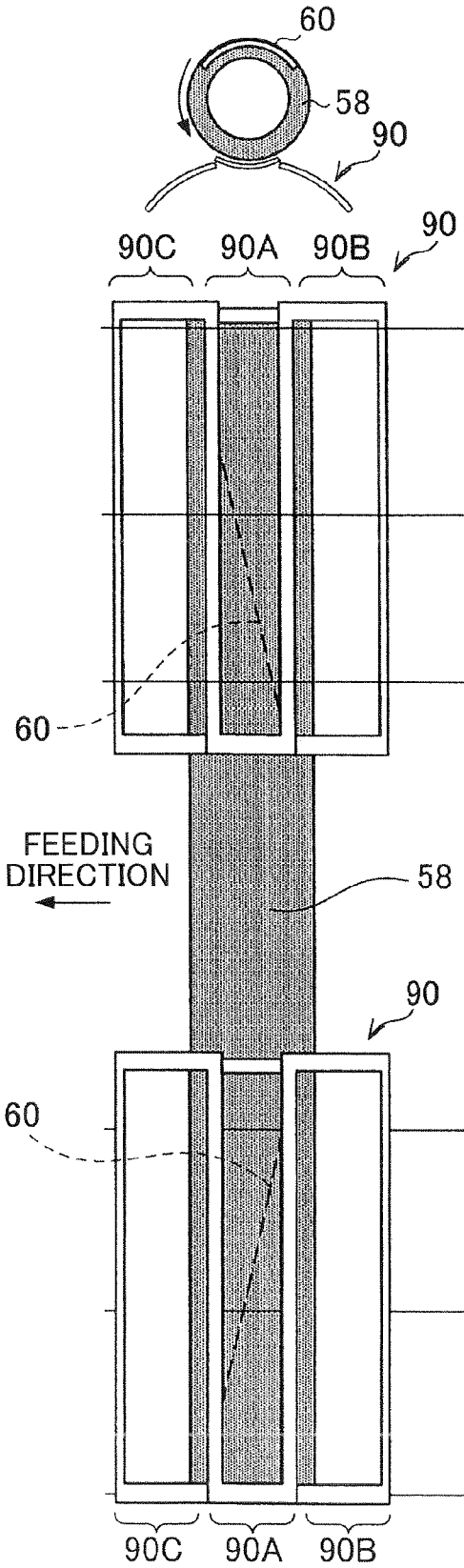
FIGS. 6A and 6B are diagrams showing a first example of the arrangement of the magnetism adjusting members.
Figure 6B:
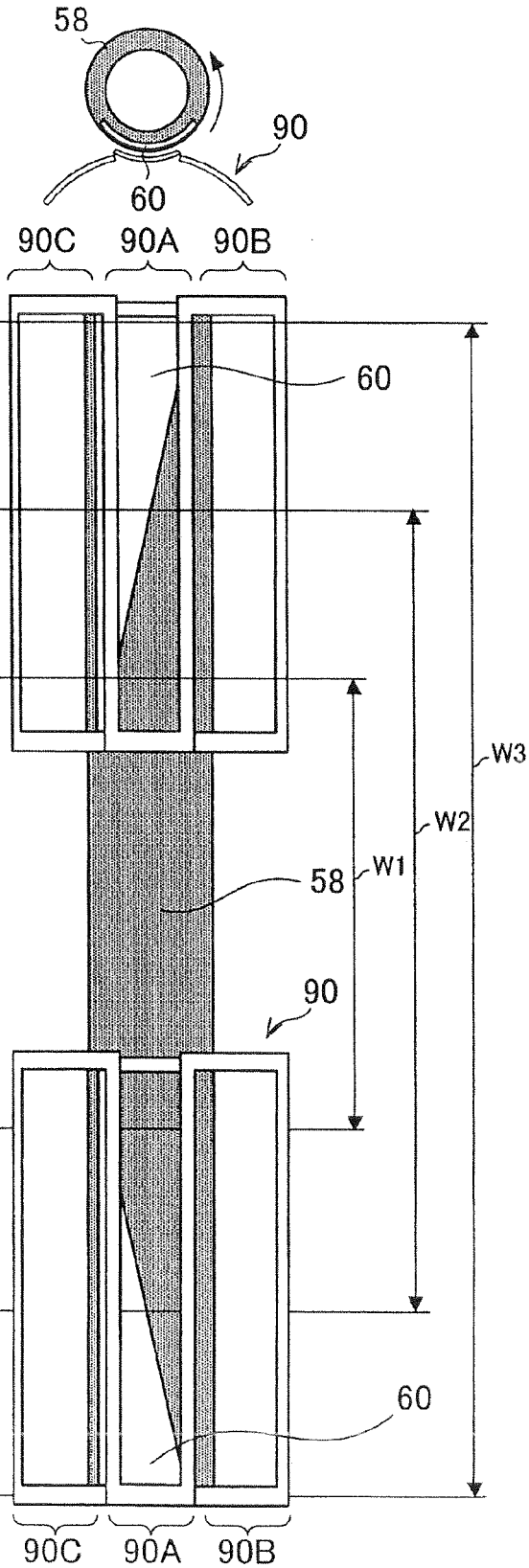

FIGS. 6A and 6B are diagrams showing a first example of the arrangement of the above magnetism adjusting members 90.

If the sheet size is maximum, the fixing device 14 retracts the shielding members 60 to the outside of the magnetic path (retracted positions) as the center cored 58 is rotated as shown in FIG. 6A. By retracting the shielding members 60 in this way, the magnetic fluxes Φ1, Φ2 and Φ2' satisfying the above conditional expression (2) can pass the magnetism adjusting members 90. In this case, the above heat roller 46 is induction-heated in the entire range of the maximum paper width W3 of sheets.

If the sheet size is smaller than the maximum paper width W3, the fixing device 14 causes the shielding members 60 to enter the magnetic path (shielding positions) as the center core 58 is rotated as shown in FIG. 6B. By placing the shielding members 60 at the shielding positions in this way, the magnetic fluxes propagating from the center core 58 to the heat roller 46 can be shielded and the state where the magnetic flux Φ1=0 can be set as described above. In this case, since the magnetism adjusting members 90 shield the magnetic fluxes in their entirety, excessive temperature increases at the opposite end portions of the heat roller 46 are prevented.

FIGS. 6A and 6B respectively show a side view and a bottom view of the center core 58 and the magnetism adjusting members 90. In FIGS. 6A and 6B, the outer surface of the center core 58 is shown in halftone.

The entire length of the center core 58 is substantially equal to or longer than the maximum paper width W3 of sheets. At this time, there are two shielding members 60 spaced apart in the longitudinal direction of the center core 58 and symmetrically shaped. The respective shielding members 60 are triangular in the plan view or in the bottom view, and parts thereof corresponding to the apices of the triangles are located near the center of the center core 58. In other words, the lengths of the shielding members 60 in a circumferential direction are shortest at the positions near the center of the center core 58 and, from these positions, gradually increase toward the opposite ends of the center core 58.

The shielding members 60 are arranged at the opposite outer sides of the range of a minimum paper width W1 orthogonal to a feeding direction, and only tiny parts of the shielding members 60 are located within the range of the minimum paper width W1. The shielding members 60 reach positions slightly outside the range of the maximum paper width W3 of sheets at the opposite ends of the center core 58. The minimum and maximum paper widths W1, W3 are determined by sheets of the minimum or maximum size printable by the printer 1.

In the first embodiment, a ratio of the length of each shielding member 60 to the outer circumferential length of the center core 58 in the rotating direction of the center core 58 differs in the longitudinal direction (lengthwise direction) of the center core 58, i.e. in a sheet width direction. At this time, if the ratio of the length (Lc) of each shielding member 60 to the outer circumferential length (L) of the center core 58 is a covering ratio (=Lc/L), the covering ratio is smaller at the inner side of the center core 58 and increases toward the outer sides (opposite ends) in the longitudinal direction. Specifically, the covering ratio is minimized in the vicinity of the minimum sheet passage area (range of the minimum paper width W1) while being, conversely, maximized at the opposite ends of the center core 58.

As described above, the respective sheet sizes (paper widths) can be dealt with by moving the shielding members 60 to the retracted positions and the shielding positions and switching the magnetic path at the respective positions to partially suppress magnetic fluxes to be generated (set the state where Φ1=0). At this time, excessive temperature increases can be prevented at the opposite ends of the heat roller 46 and the heating belt 48 by making an angle of rotation (rotational displacement amount) of the center core 58 differ according to the sheet size (paper width) such that the larger the sheet size, the smaller the magnetic shielding amount and, conversely, the smaller the sheet size, the larger the magnetic shielding amount. Although only counterclockwise rotations are shown by arrows in FIG. 6, the center core 58 may be rotated clockwise. Further, the feeding direction may be opposite to the one shown in FIG. 6.

[Second Example of the Arrangement]

Figure 7:
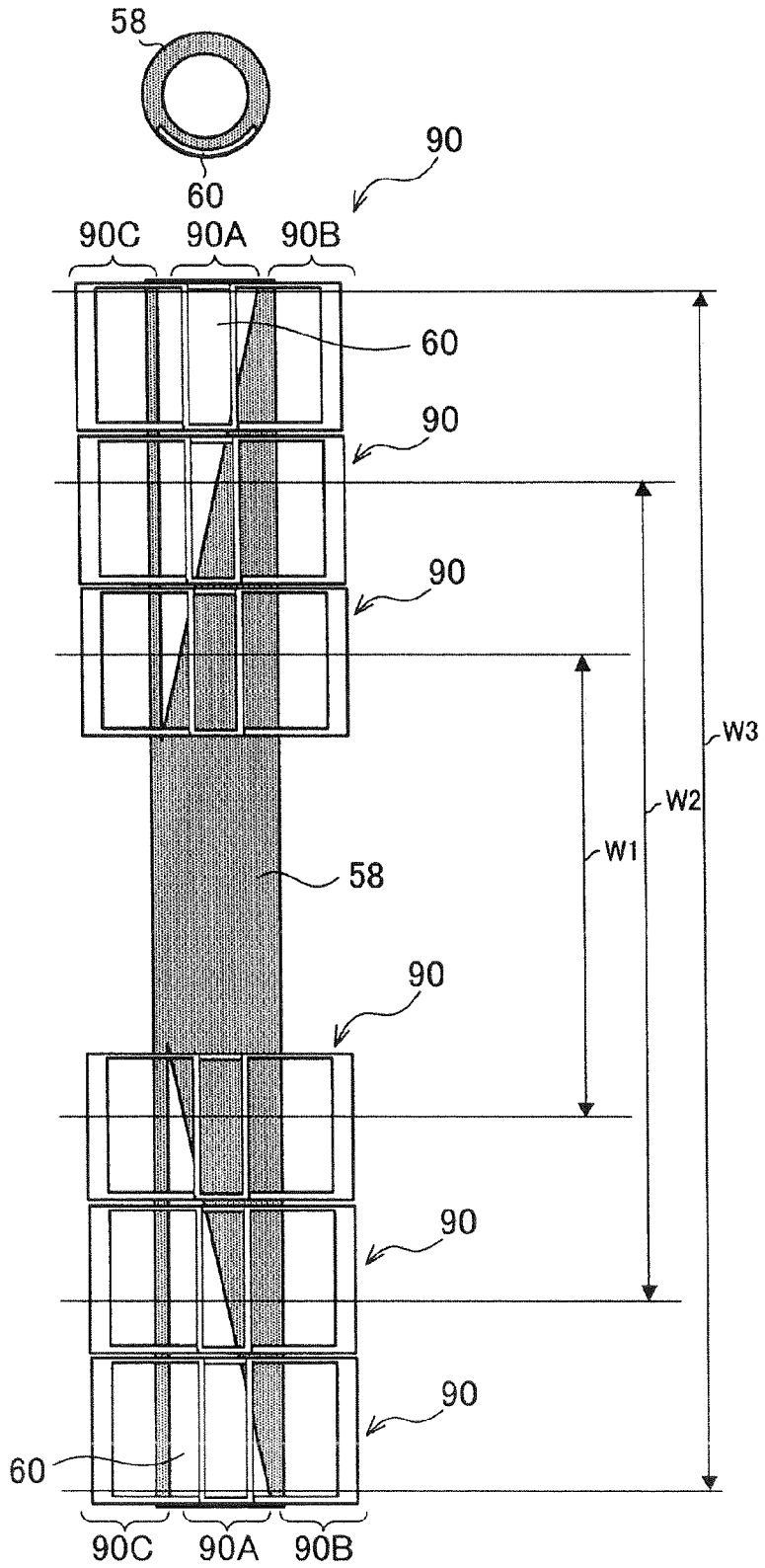
FIG. 7 is a diagram showing a second example of the arrangement of the magnetism adjusting members.

FIG. 7 is a diagram showing a second example concerning the arrangement of the magnetism adjusting members 90. In the example shown in FIG. 7, the magnetism adjusting members 90 are separated in the longitudinal direction (sheet width direction). With such a structure, the number and positions of the magnetism adjusting members 90 for shielding magnetic fluxes differ depending on the respective paper widths W1, W2 and W3.

For example, in the case of the minimum paper width W1, the shielding members 60 shield magnetic fluxes entering the central ring-shaped portions 90A of three magnetism adjusting members 90 (Φ1=0) at each of the opposite sides, whereby a magnetic flux shielding effect is exhibited by all the six magnetism adjusting members 90 at the both sides.

In the case of the medium paper width W2, the shielding members 60 shield magnetic fluxes entering the central ring-shaped portions 90A of two magnetism adjusting members 90 (Φ1=0) from each of the opposite ends, whereby a magnetic flux shielding effect is exhibited by the four magnetism adjusting members 90 at the both sides.

In the case of the maximum paper width W3, the shielding members 60 are moved to the retracted positions, so that the magnetic fluxes Φ1, Φ2 and Φ2' satisfying the conditional expression (2) are generated.

[Driving Mechanism]

Next, the mechanism for rotating the center core 58 about its longitudinal axial line, i.e. mechanism for switching the magnetic path by moving the shielding members 60 to the shielding positions and the retracted positions is described.

Figure 8:
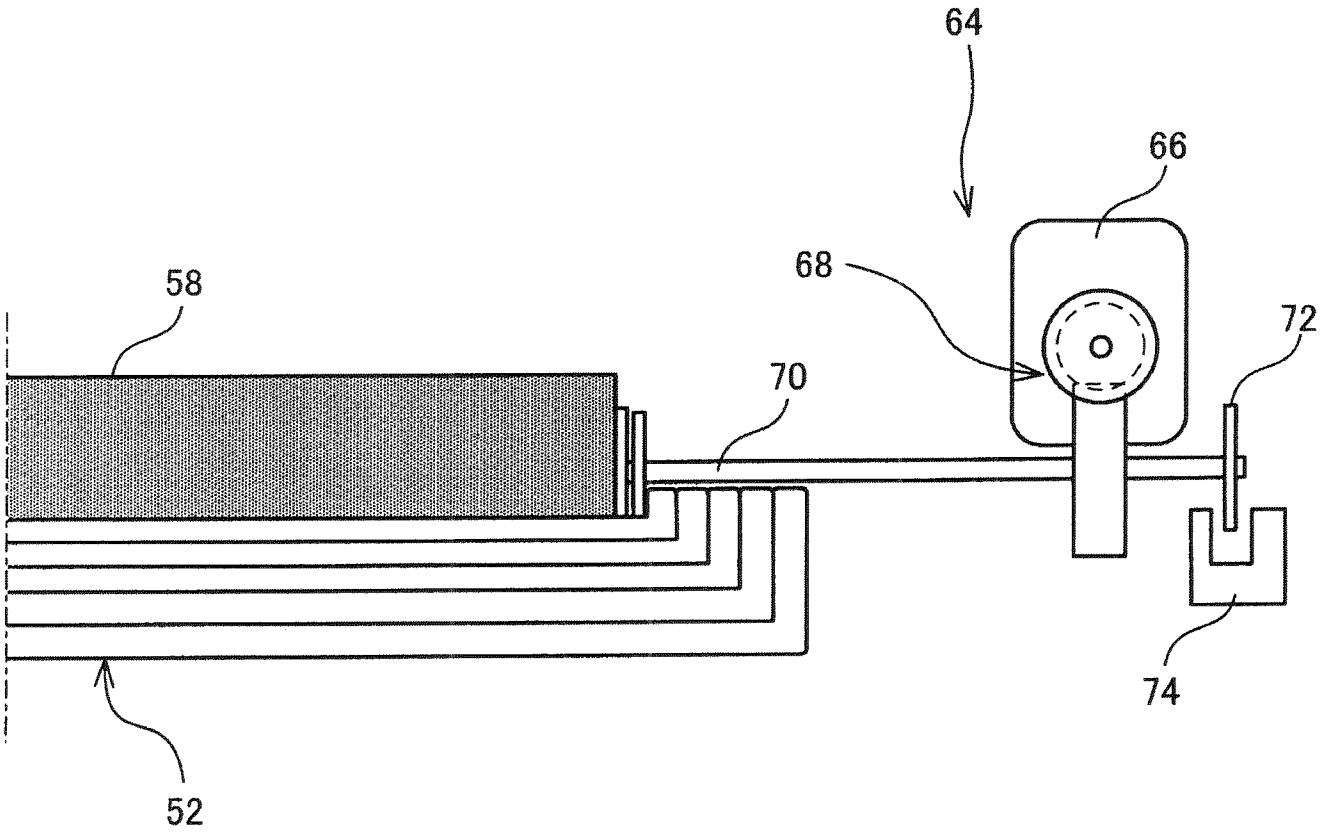
FIG. 8 is a side view showing the construction of a center core driving mechanism.

FIG. 8 is a side view showing the construction of the driving mechanism 64 for the center core 58. This driving mechanism 64 is for driving a drive shaft 70 to rotate the center core 58 while decelerating the rotation of, e.g. a stepping motor 66 using a speed reduction mechanism 68. For example, a worm gear is used in the speed reduction mechanism 68, but something different may be used. For the detection of an angle of rotation (rotational displacement amount from a reference position) of the center core 58, a slitted disk 72 is mounted on an end of the drive shaft 70 and a photointerrupter 74 is assembled with this. Since being hidden behind the induction heating coil 52, the magnetism adjusting member 90 is not shown in FIG. 8.

The above drive shaft 70 is connected with one end of the center core 58 and supports the center core 58 without penetrating inside the center core 58. The angle of rotation of the center core 58 can be controlled, for example, based on the number of drive pulses applied to the stepping motor 66 and a control circuit (not shown) for this purpose is attached to the driving mechanism 64.

The control circuit can be, for example, constructed by a control IC, input and output drivers, a semiconductor memory and the like. A detection signal from the photointerrupter 74 is input to the control IC via the input driver and the control IC detects the present angle of rotation (position) of the center core 58 based on this signal.

On the other hand, information on the present sheet size is notified to the control IC from an unillustrated image formation controller. Upon receiving this information, the control IC reads information on an angle of rotation suitable for the sheet size from the semiconductor memory (ROM) and outputs drive pulses necessary to reach the target angle of rotation at a constant frequency. The drive pulses are applied to the stepping motor 66 via the output driver and the stepping motor 66 operates upon receiving them. If it is necessary to detect only the reference position upon controlling the stepping motor 66, the slitted disk 72 may be used as an index member and the index member may be detected by the photointerrupter 74 at the above reference position.

Operation Examples

Figure 9C:
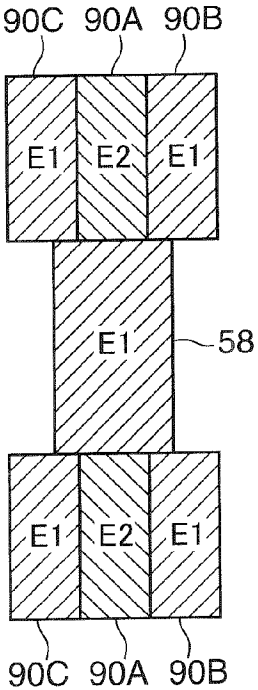
FIGS. 9A, 9B and 9C are diagrams of operation examples of the fixing device accompanying the rotation of the center core.
Figure 9B:
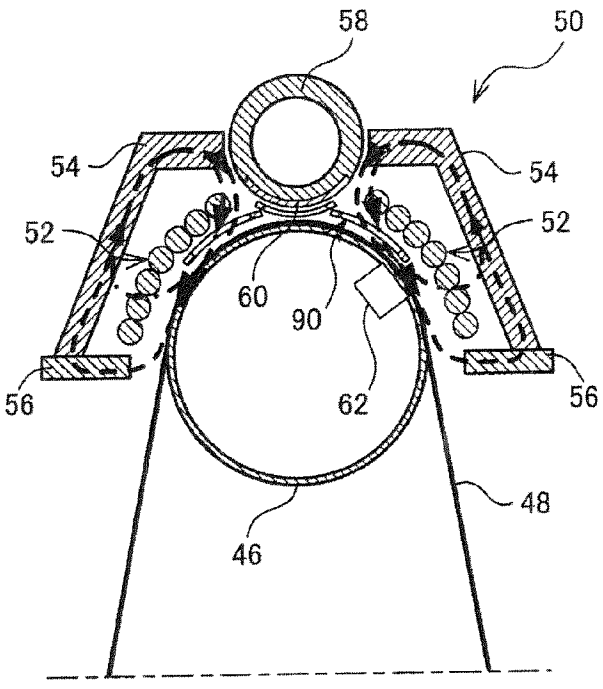
Figure 9A:
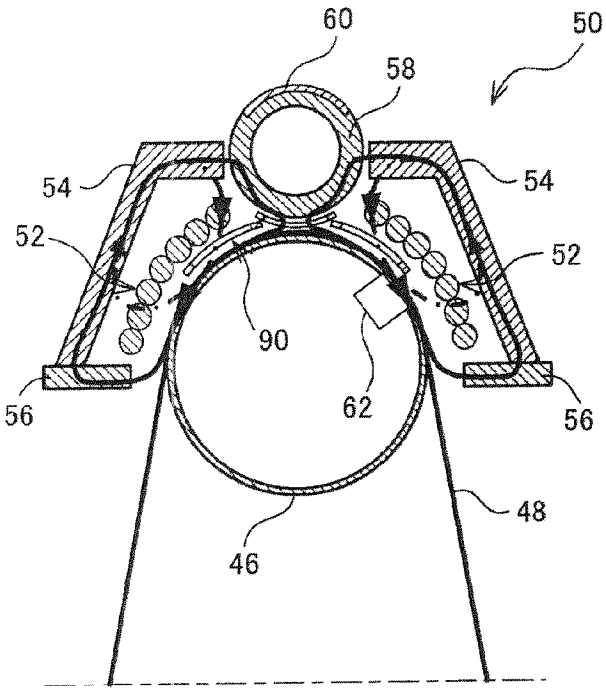

FIGS. 9A, 9B and 9C are diagrams showing operation examples of the fixing device 14 accompanying the rotation of the center core 58. These are respectively described below.

[First Paths]

FIG. 9A shows the operation example of the fixing device 14 when the shielding members 60 are moved to the retracted positions as the center core 58 is rotated. In this case, main magnetic paths are formed to pass the heating belt 48 and the heat roller 46 via first paths (thick solid lines in FIG. 9A) including the side cores 56, the arm cores 54 and the center core 58 in a magnetic field generated by the induction heating coil 52. At this time, eddy currents are generated in the heating belt 48 and the heat roller 46 that are ferromagnetic bodies, and Joule heat is generated by specific resistances of the respective materials to perform heating. At this time, the above magnetic fluxes Φ1 pass through the central ring-shaped portions 90A of the magnetism adjusting members 90.

Inside the magnetic paths passing the heating belt 48 and the heat roller 46 via the side cores 56, the arch cores 54 and the center core 58, short-cut magnetic fluxes (thick dashed-dotted lines in FIG. 9A) trying to leak out, for example, from the arch cores 54 are generated and pass through the ring-shaped portions 90B, 90C at the opposite sides of the magnetism adjusting members 90. At this time, it is assumed that the above magnetic fluxes Φ2, Φ2' pass through the respective ring-shaped portions 90B, 90C. Accordingly, not only the magnetic fluxes Φ1 passing along the main first paths, but also the leakage magnetic fluxes Φ2, Φ2' can contribute to heat generation, wherefore a heating efficiency at the time of heating over the entire width can be improved by that much.

[Second Paths]

FIG. 9B shows the operation example of the fixing device 14 when the shielding members 60 are moved to the shielding positions. In this case, since the shielding members 60 are positioned on the magnetic paths outside the minimum sheet passage area, the magnetic paths are switched to second paths (thick broken lines in FIG. 9B) coming out from the end surfaces of the arch cores 54 and reaching the heating belt 48 and the heat roller 46 without via the center core 58. In this way, the amount of heat generated outside the minimum sheet passage area is suppressed and excessive temperature increases of the heating belt 48 and the heat roller 46 can be prevented.

As the fixing device 14 shown in FIGS. 9A and 9B operates, the following magnetic field is caused by the induction heating coil 52 to act on the center core 58 having the shielding members 60 mounted thereon and the ring-shaped portions 90A, 90B and 90C of the magnetism adjusting members 90. Specifically, as shown in FIG. 9C, common magnetic field regions E1 act on the center core 58 and the ring-shaped portions 90B, 90C and uncommon magnetic field regions E2 act on the ring-shaped portions 90A. When the shielding members 60 are at the retracted positions, the first paths pass through the common magnetic field regions E1 acting on the center core 58 and the ring-shaped portions 90B, 90C and the uncommon magnetic field regions E2 acting on the ring-shaped portions 90A. In contrast, when the shielding members 60 are at the shielding positions, the second paths pass only through the common magnetic field regions E1 acting on the center core 58 and the ring-shaped portions 90B, 90C. In other words, the first paths pass through the uncommon magnetic field regions E1, but the second paths do not.

When the first paths pass through the common magnetic field regions E1 and the uncommon magnetic field regions E2, a specified area of the heating belt 48, i.e. an area corresponding to the maximum paper width W3 in the heating belt 48 in this case, is induction-heated. In contrast, when the second paths pass through the common magnetic field regions E1, a reduced area obtained by reducing the above specified area in the heating belt 48, i.e. an area corresponding to the minimum paper width W1 in the heating belt 48 in this case, is induction-heated. If it is desired to induction-heat an area corresponding to the medium paper width W2 in the heating belt 48, this area can be induction-heated by locating the shielding members 60 between the shielding positions and the retracted positions.

[Functions of the Magnetism Adjusting Members]

With the magnetic paths switched to the second paths, magnetic fluxes passing inside the central ring-shaped portions 90A of the magnetism adjusting members 90 as shown in FIG. 9B are zero (magnetic fluxes Φ1=0). At this time, weak magnetic fluxes (smaller broken-lined circulations at the inner sides of the arch cores 54) trying to leak out from the arch cores 54 are also generated in the second paths, but the magnetism adjusting members 90 can exhibit the shielding effect to all the magnetic fluxes Φ2, Φ2' passing along the second paths as described above. Thus, the fixing device 14 of the first embodiment can obtain a sufficient magnetic shielding effect in the sheet non-passage areas without excessively increasing the areas of the shielding members 60, whereby excessive temperature increases of the heating belt 48 and the heat roller 46 can be suppressed to a level lower than at present.

[Relationship between Total Amount of Heat Generated and the Shielding Effect]

Figure 10:
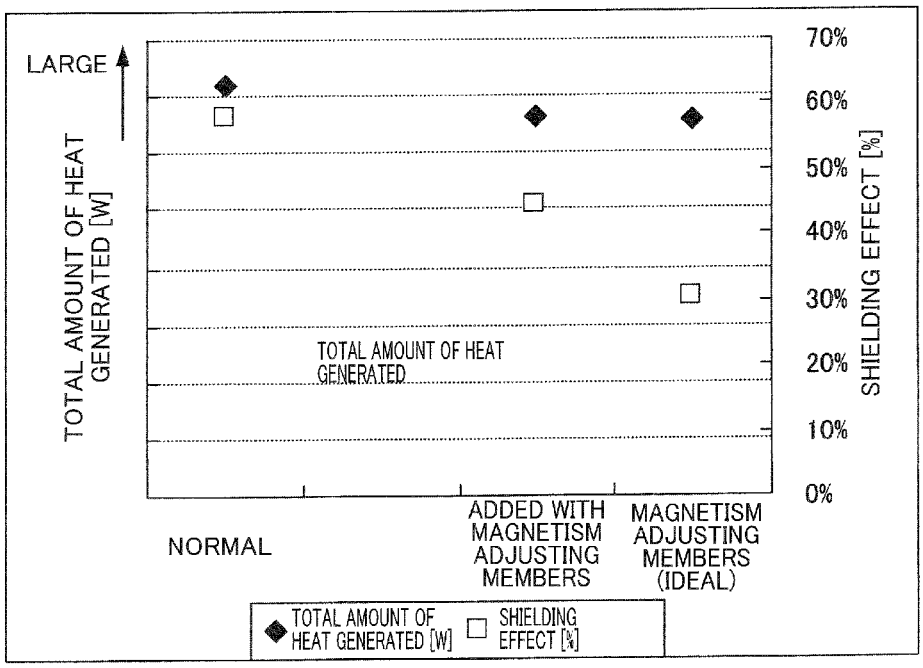
FIG. 10 is a graph showing a relationship between total amount of heat generated and a shielding effect by the fixing device.

FIG. 10 is a graph showing a relationship between the total amount of heat generated and the shielding effect by the fixing device 14. In FIG. 10, a left vertical axis represents the total amount of heat (W) as the total amount of heat of the entire heating belt 48 and heat roller 46 and points indicated by rhombuses (◆) in FIG. 10 correspond thereto. It is meant here that the larger the total amount of heat generated, the higher the heating efficiency by the IH coil unit 50.

A right vertical axis of FIG. 10 represents the magnetic shielding effect (%) for the sheet non-passage area and points indicated by rectangles (□ in halftone) correspond thereto. The shielding effect is a numerical value indicating the magnitude of a change of a "ratio of the heat amount at the end portions to that in the central part in the sheet width direction" upon switching from the first paths (state where the shielding members 60 are at the retracted positions) to the second paths (state where the shielding members 60 are at the shielding positions). Thus, it is meant that the lower the percentage of the shielding effect, the more heat generation in the end areas is suppressed.

A "normal state" where only the shielding members 60 are mounted on the center core 58, but the magnetism adjusting members 90 are not used is shown on the left side of a horizontal axis of FIG. 10. A state where the above magnetism adjusting members 90 are added is shown on an intermediate part, and a state where magnetism adjusting members designed on ideal conditions are used is shown on the right side.

[In Normal State]

If the magnetism adjusting members 90 are not mounted, the total amount of heat (♦ point) is at a high level and the percentage of the shielding effect (□ point) is at a high level, from which it can be understood that the heat generation in the end areas cannot be suppressed very much.

[At the Time of Adding the Magnetism Adjusting Members]

In contrast, if the magnetism adjusting members 90 are mounted, the total amount of heat (♦ point) is still at a high level, but the percentage of the shielding effect (□ point) is decreased to a low level. Accordingly, it can be understood that the heat generation in the end areas of the IH coil unit 50 can be drastically suppressed if the magnetism adjusting members 90 of the first embodiment are used.

[On the Ideal Conditions]

According to a simulation result using the magnetism adjusting members designed on the ideal conditions, the total amount of heat (♦ point) is still kept at a high level, but the percentage of the shielding effect (□ point) is decreased to a considerably low level. Accordingly, it is clear that excessive temperature increases in unheated areas can be sufficiently suppressed without sacrificing the total amount of heat by the IH coil unit 50 by setting the shape, the size, the arrangement and the like of the magnetism adjusting members 90 of the first embodiment to ideal conditions.

Based on the above fixing device 14 of the first embodiment, the following fixing devices 14 of second to ninth embodiments can be cited. The respective embodiments are described below. The construction common to the first embodiment is identified and shown by common reference numerals and not repeatedly described in any of the embodiments. If the materials and the like of the parts are particularly different even though the parts are identified by the common reference numerals, these parts are additionally described.

Second Embodiment

Figure 11:
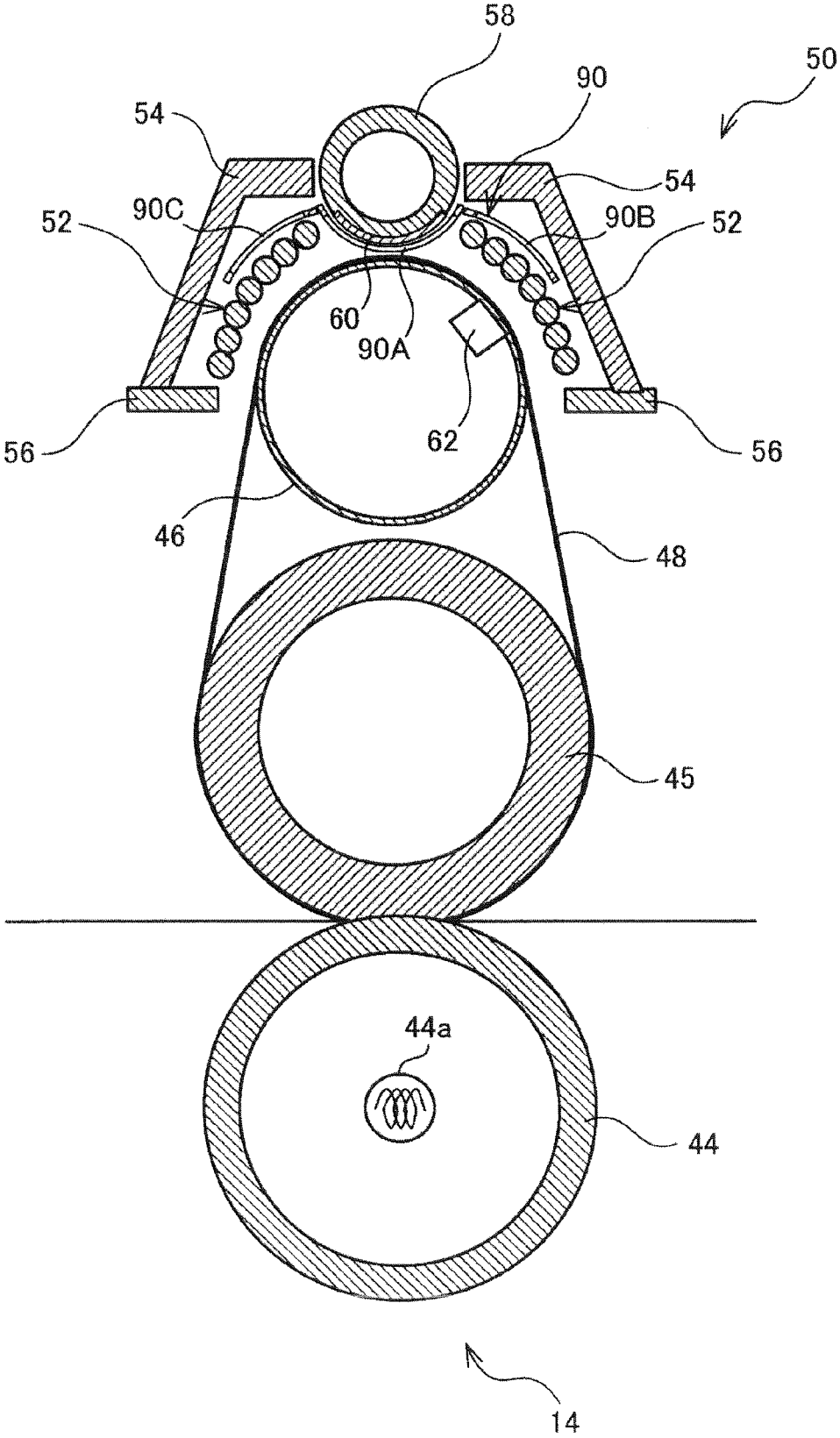
FIG. 11 is a vertical section showing a structure example of a fixing device according to a second embodiment.

FIG. 11 is a vertical section showing a structure example of the fixing device 14 of the second embodiment. The arrangement and form of magnetism adjusting members 90 of the second embodiment differ from those of the first embodiment.

Specifically, although ring-shaped portions 90A of the magnetism adjusting members 90 are arranged between the center core 58 and the heating belt 48, ring-shaped portions 90B, 90C at the opposite sides are arranged outside the induction heating coil 52, i.e. between the arch cores 54 and the induction heating coil 52. It does not matter which of the above first example (FIG. 6) and second example (FIG. 7) is employed for the arrangement of the magnetism adjusting members 90 in the longitudinal direction.

Also in the second embodiment, if the conditional expression (1) is satisfied in the state switched to the first paths as described above (state where the shielding members 60 are located at the retracted positions), the magnetism adjusting members 90 can satisfactorily permit the passage of magnetic fluxes similar to the first embodiment. Further, if the magnetic fluxes Φ1 passing through the central ring-shaped portions 90A can be zeroed in the state switched to the second paths (state where the shielding members 60 are located at the shielding positions), the magnetism adjusting members 90 can exhibit the magnetic flux shielding effect in their entirety.

Third Embodiment

Figure 12:
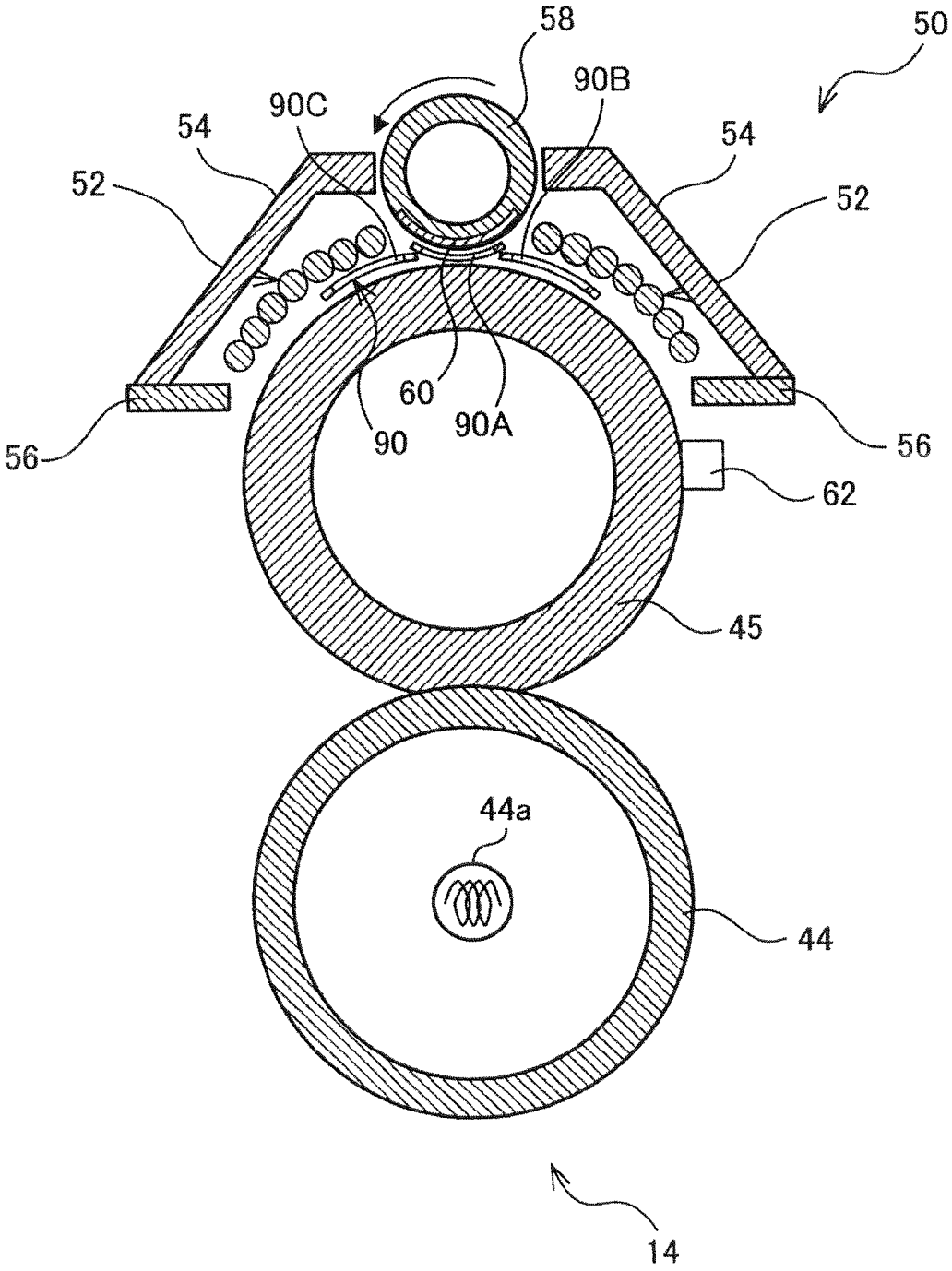
FIG. 12 is a vertical section showing a structure example of a fixing device according to a third embodiment.

FIG. 12 is a vertical section showing a structure example of the fixing device 14 of the third embodiment. In the third embodiment, a toner image is fixed by a fixing roller 45 and the pressing roller 44 without using the above heating belt. A magnetic body similar to the above heating belt is, for example, wound around the outer peripheral surface of the fixing roller 45, and the magnetic body is induction-heated by the induction heating coil 52. In this case, the thermistor 62 is disposed at a position to face a magnetic body layer outside the fixing roller 45.

Also in such a fixing device 14 of the third embodiment, the magnetism adjusting members 90 can be applied as shown. Similarly, it does not matter which of the above first example (FIG. 6) and second example (FIG. 7) is employed for the arrangement of the magnetism adjusting members 90 in the longitudinal direction.

Fourth Embodiment

Figure 13:
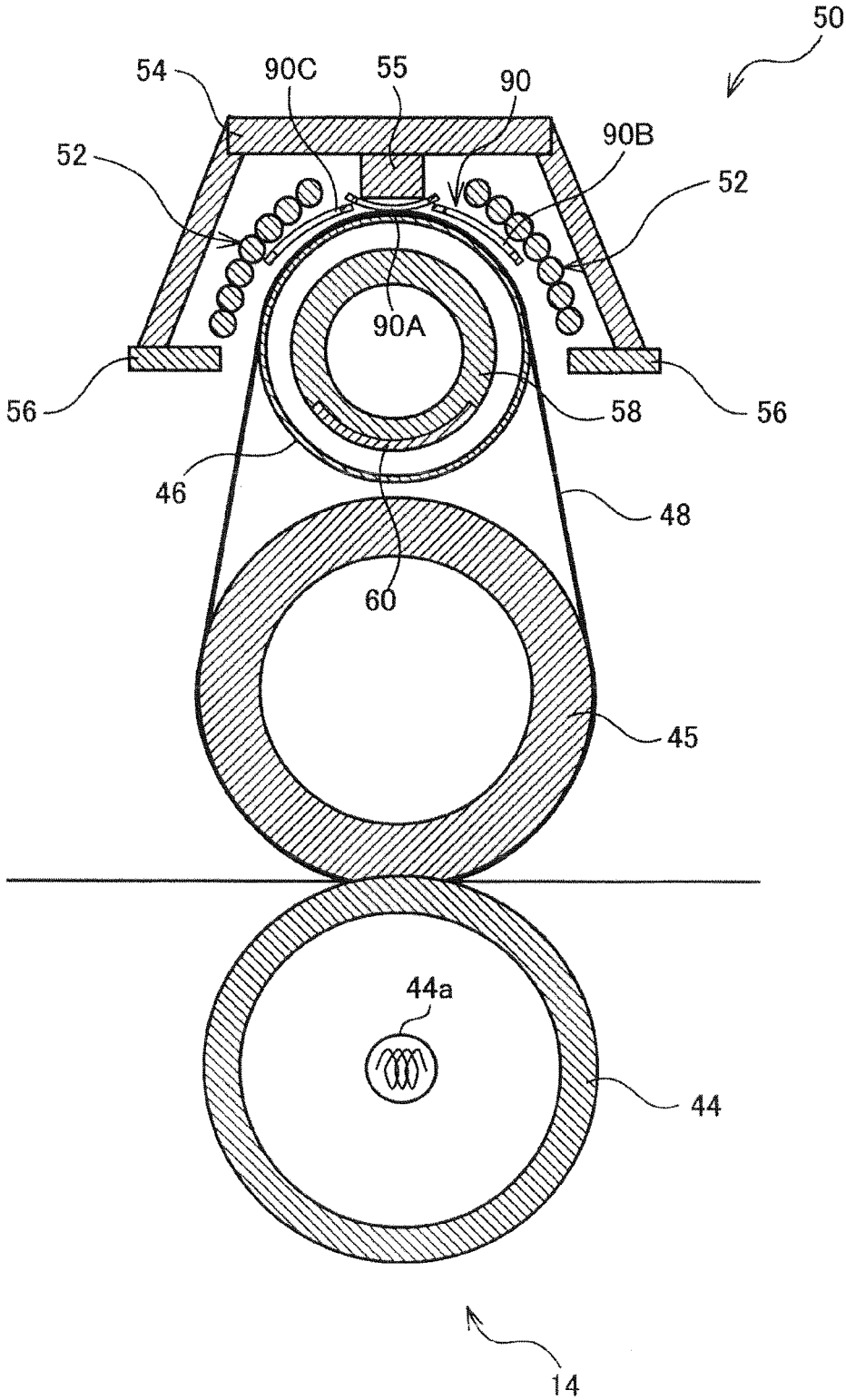
FIG. 13 is a vertical section showing a structure example of a fixing device according to a fourth embodiment.

FIG. 13 is a vertical section showing a structure example of the fixing device 14 of the fourth embodiment. The fourth embodiment differs from the first embodiment in that a heat roller 46 is made of a nonmagnetic metallic material (e.g. SUS: stainless steel) and the center core 58 is arranged in the heat roller 46. In addition, arch cores 54 are connected in the center and an intermediate core 55 is arranged below the arch core 54.

If the heat roller 46 is made of a nonmagnetic metal, a magnetic field generated by the induction heating coil 52 passes through the side cores 56, the arch cores 54 and the intermediate core 55 and penetrates through the heat roller 46 to reach the center core 58 inside. The heating belt 48 is induction-heated by the penetrating magnetic field.

In the case of the fourth embodiment, the state switched to the first paths (retracted positions) is set if the shielding members 60 are moved away from the intermediate core 55 as shown in FIG. 13. In this case, the magnetic shielding effect by the shielding members 60 does not act and the heating belt 48 is induction-heated in a maximum sheet passage area. On the other hand, if the shielding members 60 are moved to positions to face the intermediate core 55 (shielding positions), the magnetic paths are switched to the second paths and excessive temperature increases outside the sheet passage area are suppressed.

Also in such a fixing device 14 of the fourth embodiment, functions similar to the first embodiment can be displayed by arranging the magnetism adjusting members 90, for example, between the intermediate core 55 and the heating belt 48 and between the induction heating coil 52 and the heating belt 48. Similarly, it does not matter which of the above first example (FIG. 6) and second example (FIG. 7) is employed for the arrangement of the magnetism adjusting members 90 in the longitudinal direction.

Fifth Embodiment

Figure 14:
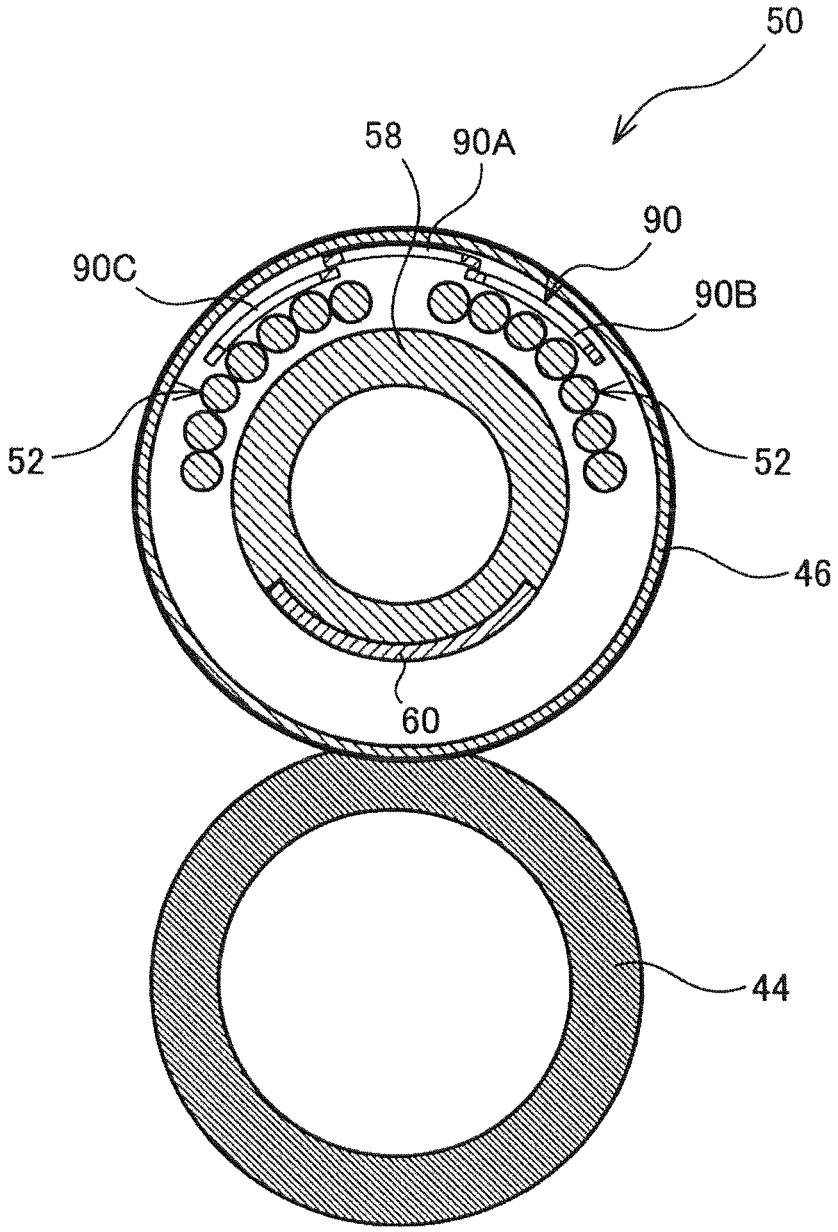
FIG. 14 is a vertical section showing a structure example of a fixing device according to a fifth embodiment.

FIG. 14 is a vertical section showing a structure example of the fixing device 14 of the fifth embodiment. In this fifth embodiment, an IH coil unit 50 is of the so-called internal IH type. Specifically, a heat roller 46 is made of a nonmagnetic metal (e.g. SUS) and has a relatively large diameter (e.g. 40 mm), and the induction heating coil 52 and the center core 58 are accommodated inside. The arch cores 54 and the side cores 56 as in the first to fourth embodiments are not provided outside the heat roller 46. A mold releasing layer (PFA) is formed on the outer surface of the heat roller 46. A pressing roller 44 is similar to the first to third embodiments.

In the internal IH as in the fifth embodiment, a magnetic field generated by the induction heating coil 52 is guided by the center core 58 inside the heat roller 46, thereby induction-heating the heat roller 46. In the case of the fifth embodiment, the state switched to the first paths (retracted positions) is set if the shielding members 60 are moved away from the induction heating coil 52 as shown in FIG. 14. In this case, the magnetic shielding effect does not act and the heating belt 48 is induction-heated in the maximum sheet passage area. On the other hand, if the shielding members 60 are moved to positions to face the induction heating coil 52 (shielding positions), the magnetic paths are switched to the second paths and excessive temperature increases outside the sheet passage area are suppressed.

Also in such a fixing device 14 of the fifth embodiment, the magnetism adjusting members 90 can be fixedly arranged, for example, between the inner peripheral surface of the heat roller 46 and the induction heating coil 52 as shown. Similarly, it does not matter which of the above first example (FIG. 6) and second example (FIG. 7) is employed for the arrangement of the magnetism adjusting members 90 in the longitudinal direction.

Sixth Embodiment

Figure 15:
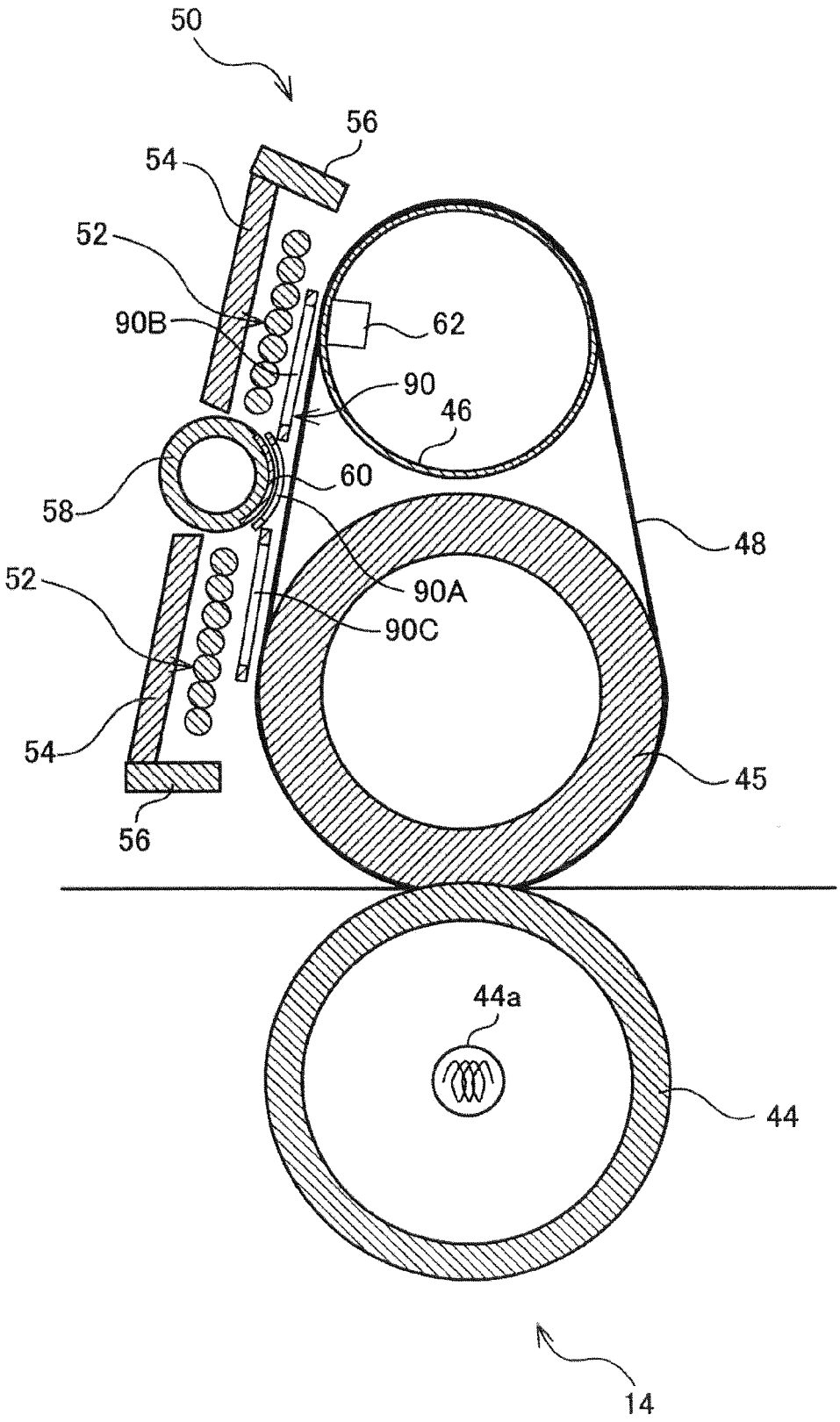
FIG. 15 is a vertical section showing a structure example of a fixing device according to a sixth embodiment.

FIG. 15 is a vertical section showing a structure example of the fixing device 14 of the sixth embodiment. In this sixth embodiment, induction heating is performed not at an arcuate position of the heating belt 48, but at a flat position between the heat roller 46 and the fixing roller 45. Similarly in this case, the magnetic paths can be switched by rotating the center core 58. Magnetism adjusting members 90 can satisfactorily permit the passage of magnetic fluxes upon the switch to the first paths and can exhibit the magnetic shielding effect upon the switch to the second paths.

Only central ring-shaped portions 90A of the magnetism adjusting members 90 are curved, and ring-shaped portions 90B, 90C at the opposite sides are flat without being curved. Such magnetism adjusting members 90 are fixedly arranged, for example, between the induction heating coil 52 and the heating belt 48. Similarly, it does not matter which of the above first example (FIG. 6) and second example (FIG. 7) is employed for the arrangement of the magnetism adjusting members 90 in the longitudinal direction.

Seventh Embodiment

Figure 16:
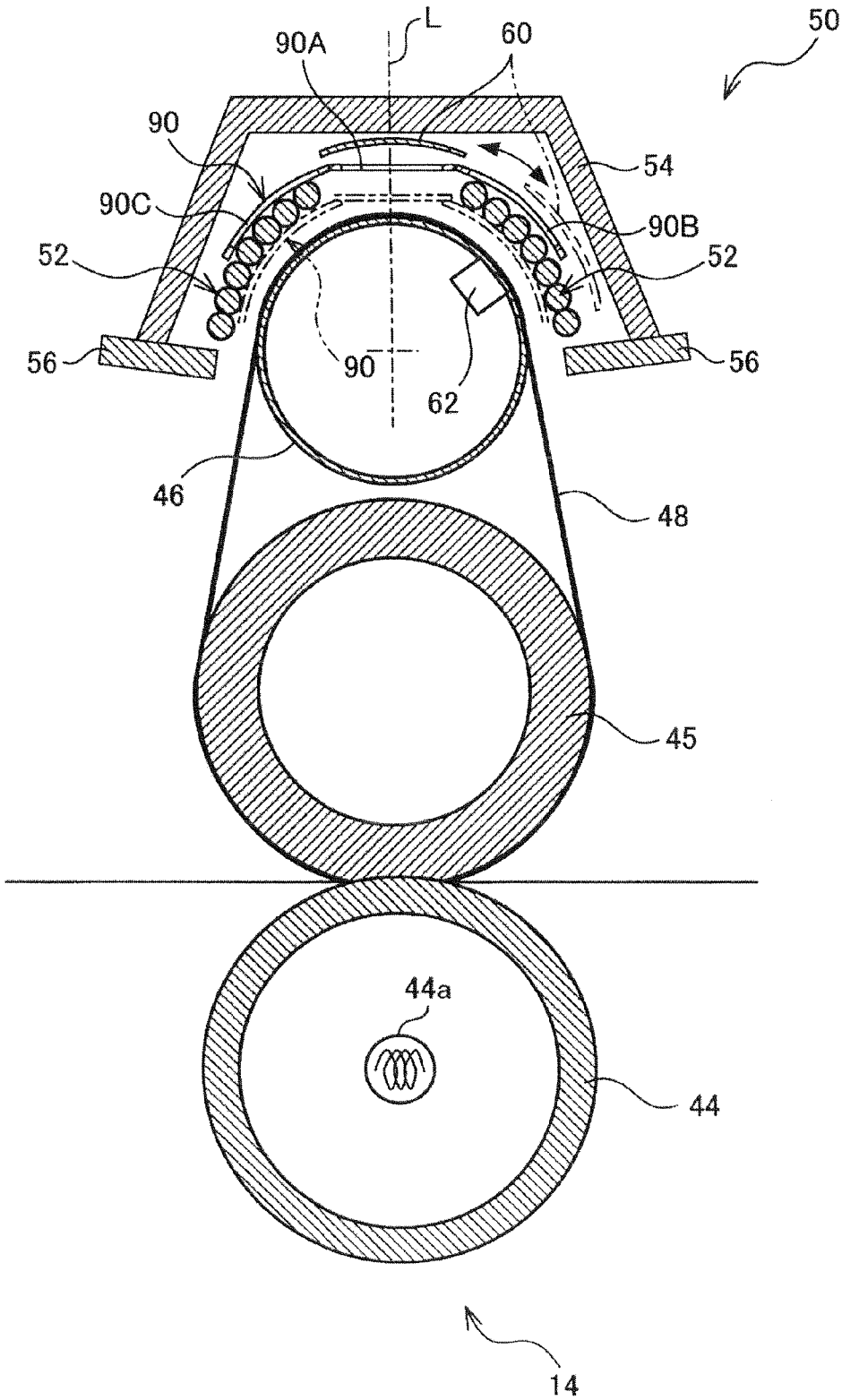
FIG. 16 is a vertical section showing a structure example of a fixing device according to a seventh embodiment.

FIG. 16 is a vertical section showing a structure example of the fixing device 14 of the seventh embodiment. In this seventh embodiment, magnetic paths are switched by moving only the shielding members 60 without using the center core 58. The arch cores 54 at the opposite sides are connected with each other, and the shielding members 60 are moved in directions of arrows in FIG. 16 along the inner surface of the arch core 54. It does not matter which of the above first example (FIG. 6) and second example (FIG. 7) is employed for the arrangement of the magnetism adjusting members 90 in the longitudinal direction.

Although not particularly shown, the fixing device 14 of the seventh embodiment includes a driving mechanism similar to that of the first embodiment and the shielding members 60 can be moved about the same center point as the center of rotation of the heat roller 46 by this driving mechanism.

[First Paths]

If the shielding members 60 are moved to retracted positions which are displaced from a winding center L of the induction heating coil 52 and located between the arch cores 54 and the induction heating coil 52 as shown by chain double-dashed lines in FIG. 16, the state switched to the first paths are set in the seventh embodiment. In this case, magnetic fluxes reach the heating belt 48 and the heat roller 46 along the winding center 1 from the center position of the arch core 54. At this time, the magnetism adjusting members 90 satisfactorily permit the passage of the magnetic fluxes similar to the first embodiment.

As shown by chain double-dotted line in FIG. 16, the magnetism adjusting members 90 may be arranged not only at the outer side of the induction heating coil 52, but also at the inner side thereof in the seventh embodiment.

[Second Paths]

On the other hand, if the shielding members 60 are located on a line of the winding center L of the induction heating coil 52 as shown by solid line in FIG. 16, the magnetic paths are switched from the first paths to the second paths. In this case, since the magnetic fluxes 11 entering the central ring-shaped portions 90A of the magnetism adjusting members 90 become zero, the magnetism adjusting members 90 can shield the magnetic fluxes in their entirety.

Eighth Embodiment

Figure 17:
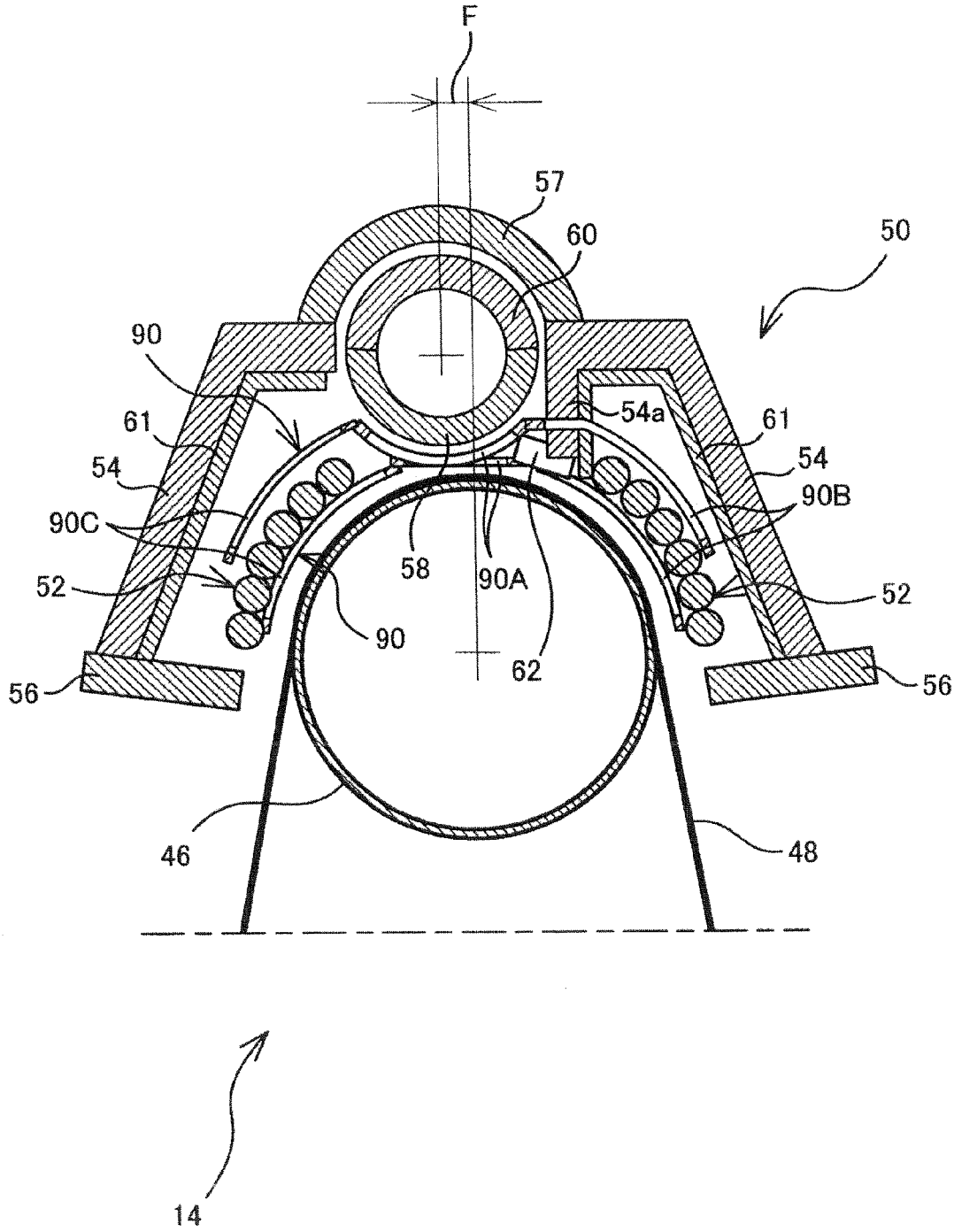
FIG. 17 is a partial vertical section showing a structure example of a fixing device according to an eighth embodiment.

FIG. 17 is a partial vertical section showing a structure example of the fixed device 14 of the eighth embodiment. Only the IH coil unit 50 of the fixed device 14 is enlargedly shown in FIG. 17. The following description is centered on differences from the first embodiment.

In the eighth embodiment, another connecting core 57 is arranged outside the center core 58 to connect the arch cores 54 at the opposite sides to each other. One (right one in FIG. 17) of the arch cores 54 at the opposite sides has one end thereof bent substantially at a right angle lateral to the center core 58, and this bent part extends through the inside of the induction heating coil 52 up to the vicinity of the heating belt 48 and the heat roller 46.

Thus, in the eight embodiment, the center of rotation of the center core 58 is offset (F in FIG. 17) toward one side (left side in FIG. 17) with respect to the center of rotation of the heat roller 46 by as much as the bent part of the one arch core 54. Further, the shielding members 60 are provided in a substantially half area of the center core 58 in the circumferential direction.

The magnetism adjusting members 90 are arranged not only at the outer side of the induction heating coil 52, but also at the inner side thereof as shown in the seventh embodiment. At this time, the bent part of the arch core 54 is assumed to be arranged at such a position as to penetrate through the ring-shaped portions 90C at one side of the magnetism adjusting members 90.

Also in the eighth embodiment, the magnetic paths can be switched to the first and second paths by rotating the center core 58 similar to the first embodiment. Particularly, according to the structure of the eighth embodiment, a degree of magnetic coupling can be improved upon the switch to the second paths by providing the arch core 54 with the bent part. Further, other shielding members 61 are, for example, bonded to the inner surfaces of the arch cores 54 and contribute to the shielding of leakage magnetic fluxes from the arch cores 54.

Accordingly, in the eighth embodiment, the magnetic fluxes Φ2, Φ2' can be caused to reliably propagate toward the ring-shaped portions 90B, 90C at the opposite sides of the magnetism adjusting members 90 upon the switch from the first paths to the second paths, wherefore the shielding effect can be reliably exhibited there. It does not matter which of the above first example (FIG. 6) and second example (FIG. 7) is employed for the arrangement of the magnetism adjusting members 90 in the longitudinal direction also here.

Although the example of providing one arch core 54 with the bent part is shown in FIG. 17, bent parts may be provided at the both arch cores 54.

Ninth Embodiment

Figure 18:
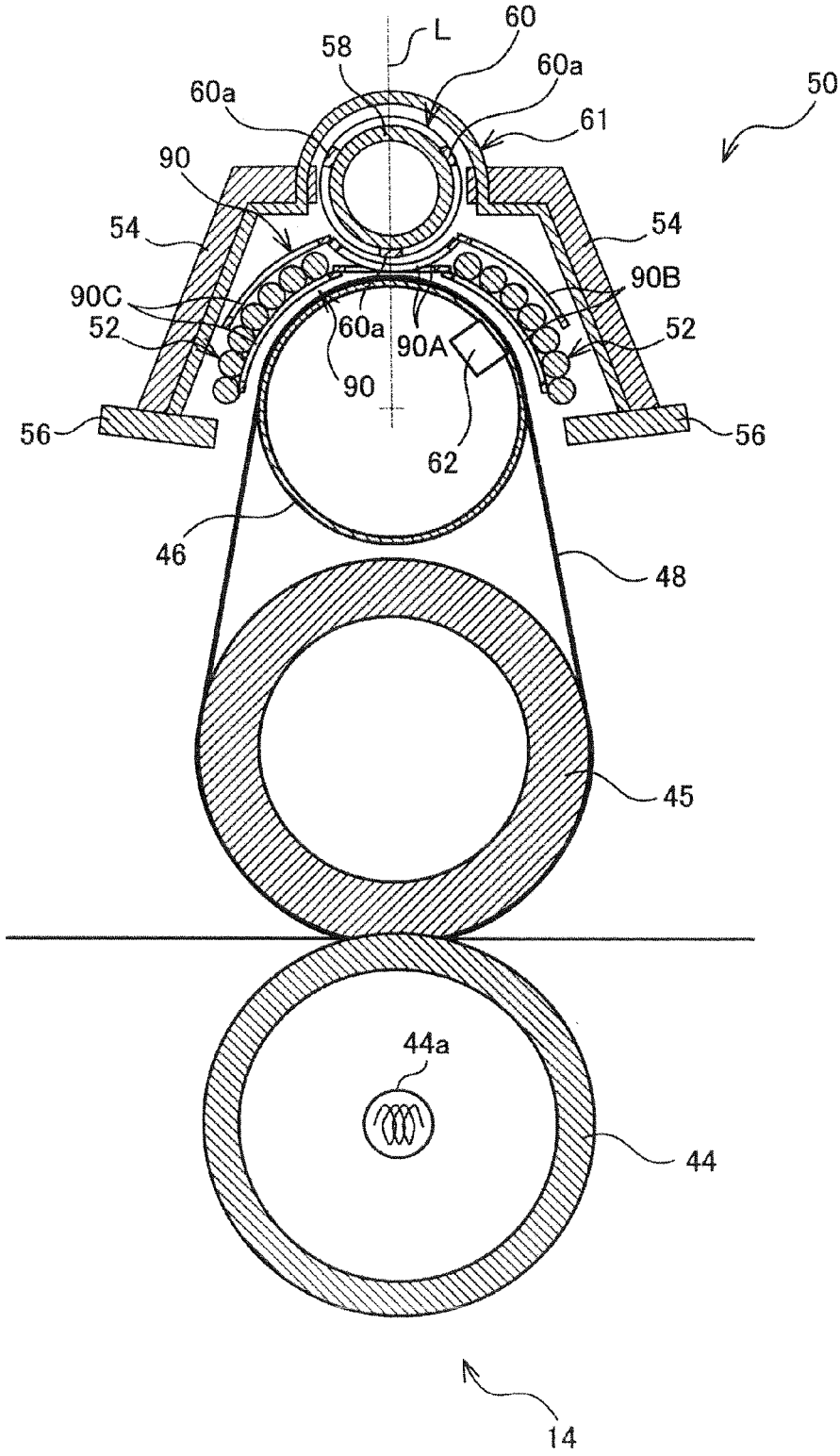
FIG. 18 is a vertical section showing a structure example of a fixing device according to a ninth embodiment, member.

FIG. 18 is a vertical section showing a structure example of the fixed device 14 of the ninth embodiment. The following description is centered on differences from the first embodiment.

The ninth embodiment largely differs from the first embodiment in that the shielding members 60 are ring-shaped and differs therefrom in that the magnetism adjusting members 90 are arranged at the inner and outer sides of the induction heating coil 52 similar to the eighth embodiment. Other shielding members 61 are bonded to the inner surfaces of the arch cores 54, and leakage magnetic fluxes from the arch cores 54 are shielded by these shielding members 61. The shielding members 61 extend from the arch cores 54 at the opposite sides up to the outer side (upper side in FIG. 18) of the center core 58 and are connected with each other at this position.

[Ring-Shaped Shielding Members]

Figure 19:
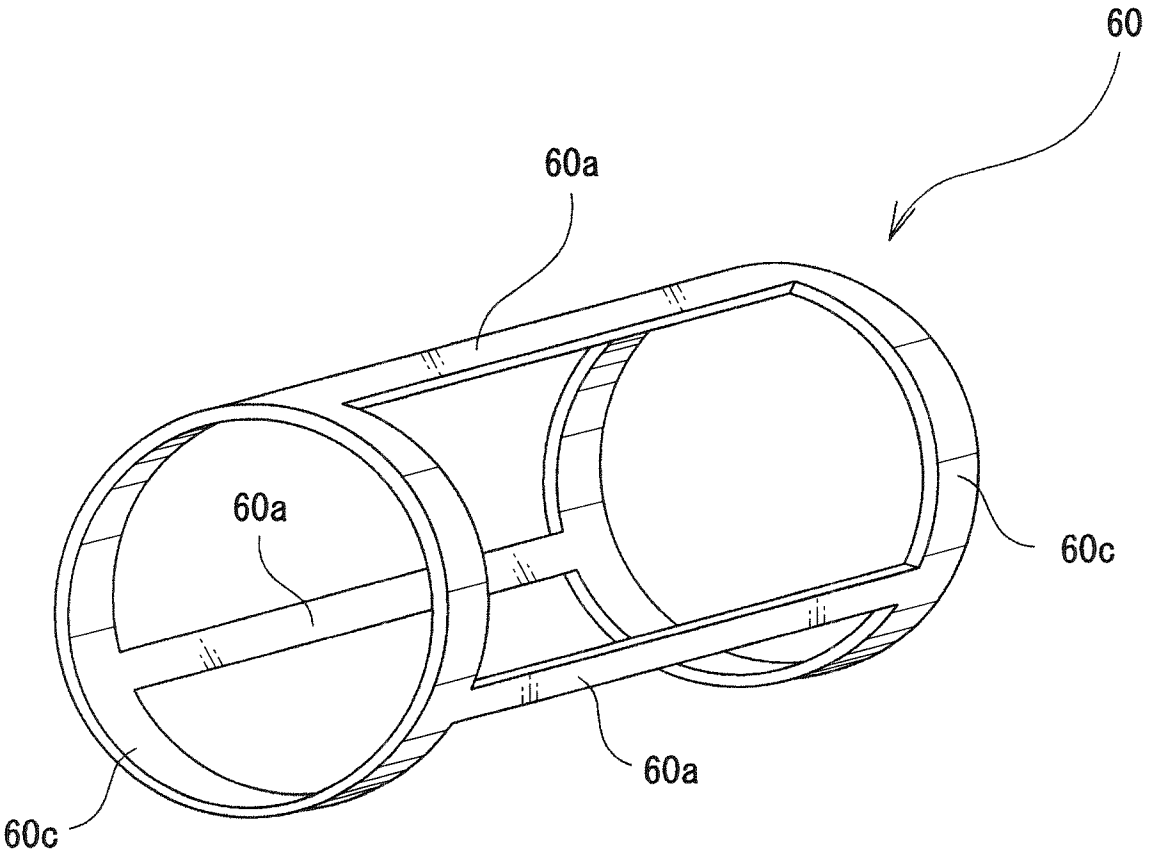
FIG. 19 is a perspective view showing a structure example of a ring-shaped shielding

FIG. 19 is a perspective view showing a structure example of the ring-shaped shielding member 60 (the center core 58 is not shown). The ring-shaped shielding member 60 has the shape of a reel as a whole. In other words, in this structure example, the shielding member 60 includes a pair of ring-shaped portions 60*c* at the opposite longitudinal end positions, and these ring-shaped portions 60*c* are connected by three straight portions 60*a*. The straight portions 60*a* are arranged at intervals in a circumferential direction of the ring-shaped portions 60*c*. Also with the ring-shaped structure example, the shielding members 60 are arranged at one end and the other end (outside the minimum sheet passage area) of the center core 58.

In the shielding member 60 with such a structure, ring-shaped parts are formed at three positions in the circumferential direction. In other words, the shielding member 60 includes three ring parts as a whole since one ring part is formed by two straight portions 60*a* adjacent in the circumferential direction and the ring-shaped portions 60*c* connecting these.

[Magnetic Path Switching Principle]

Figure 20A:
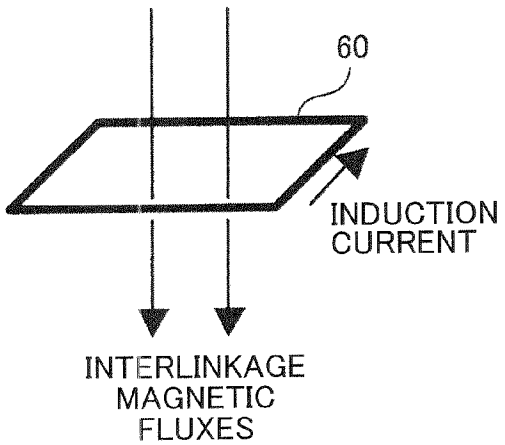
FIGS. 20A to 20C are conceptual diagrams showing the principle of switching a magnetic path by the ring-shaped shielding member.
Figure 20B:
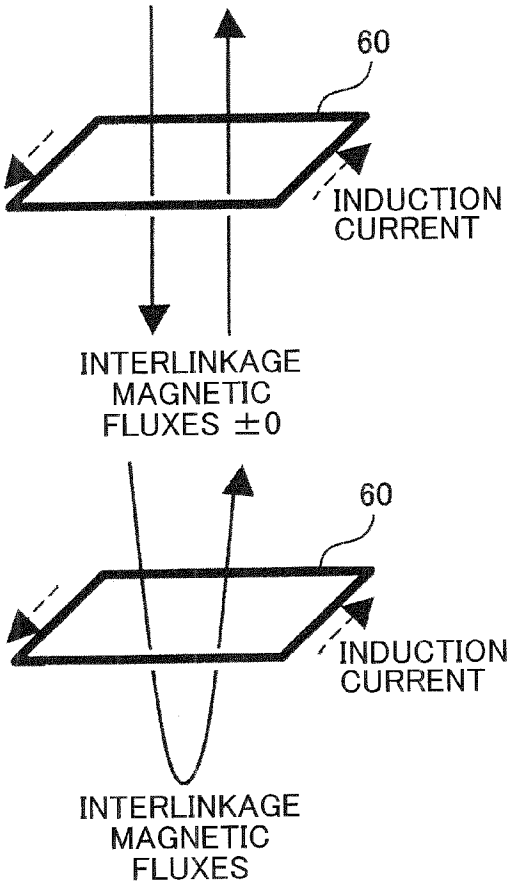
Figure 20C:
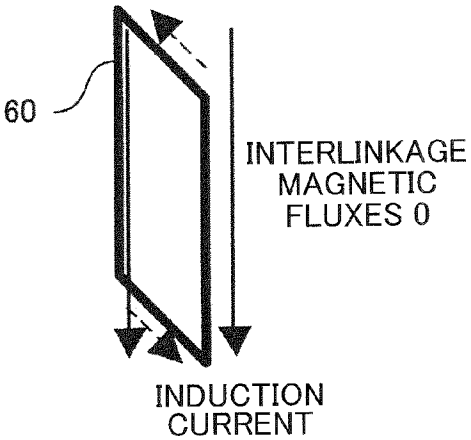

FIGS. 20A, 20B and 20C are conceptual diagrams showing a magnetic path switching principle by the ring-shaped shielding member 60. In FIG. 20, the shielding member 60 is simplified as a mere wire model and represents only one ring part.

If a penetrating magnetic field (interlinkage fluxes) is generated in a direction (one direction) perpendicular to a ring surface (virtual plane) of the ring-shaped shielding member 60, an induction current is accordingly generated in a circumferential direction of the shielding member 60 as shown in FIG. 20A. Then, a magnetic field (opposite magnetic field) acting in a direction opposite to the penetrating magnetic field is generated by electromagnetic induction, wherefore these magnetic fields cancel each other to eliminate the magnetic fields. In the ninth embodiment, the switch to the second paths is realized by using this magnetic field canceling effect.

A case is assumed where penetrating magnetic fields are generated in both directions through the ring surface of the ring-shaped magnetism adjusting member 60 as shown in an upper part of FIG. 20B and the sum total of the interlinkage fluxes at this time is substantially 0 (±0). In this case, substantially no induction current is generated in the magnetism adjusting member 60. Accordingly, the magnetism adjusting member 60 hardly exhibits its magnetic field canceling effect and the magnetic fields just pass the magnetism adjusting member 60 in both directions. This similarly holds also in the case where a magnetic field passes the inner side of the magnetism adjusting member 60 in a U-turn direction as shown in a lower part of FIG. 20B. In the ninth embodiment, the shielding members 60 are retracted to positions where the magnetic field does not penetrate in any direction to permit the passage of the magnetic field, whereby the switch to the first paths is realized.

FIG. 20C shows a case where a magnetic field (interlinkage fluxes) is generated substantially in parallel with the ring surface of the ring-shaped magnetism adjusting member 60. In this case as well, substantially no induction current is similarly generated in the magnetism adjusting member 60, wherefore there is no magnetic field canceling effect. It should be noted that this technique is not employed in the ninth embodiment, but a retraction technique mainly used in prior art. However, in order to obtain such a magnetic field environment around the induction heating coil 52, the shielding members 60 need to be largely displaced and a movement enabling space is increased by that much.

By rotating the ring-shaped shielding members 60 together with the center core 58 as described above, the state shown in FIG. 20A and that shown in FIG. 20B can be changed. In this way, the first and second paths can be switched in the ninth embodiment.

[First Paths]

Specifically, in a state where one straight portion 60*a* of the shielding member 60 is closest to the heating belt 48 and the heat roller 46 on the winding center L as shown in FIG. 18, the two ring parts formed at the opposite sides of this straight portion 60*a* are set in the state of FIG. 20B for the magnetic field. In this case, the magnetic fluxes directly reach the heating belt 48 and the heat roller 46 via the center core 58 from the arch cores 54 without being shielded by the shielding member 60, wherefore it can be understood that the switch to the first paths is realized by this.

[Second Paths]

If the center core 58 is rotated by 60° in one direction in the state shown in FIG. 18, the two straight portions 60*a* are paired at the opposite sides of the winding center L and the ring part enclosed by these straight portions 60*a* is located substantially perpendicularly to the winding center L. Since the ring part is set in the state of FIG. 20A for the magnetic field in this case, the magnetic fluxes are shielded by the shielding member 60. In this way, the switch to the second paths is realized in the ninth embodiment. The functions of the magnetism adjusting members 90 are the same as in the first embodiment.

[Ring-Shaped Structure Example 2]

Figure 21:
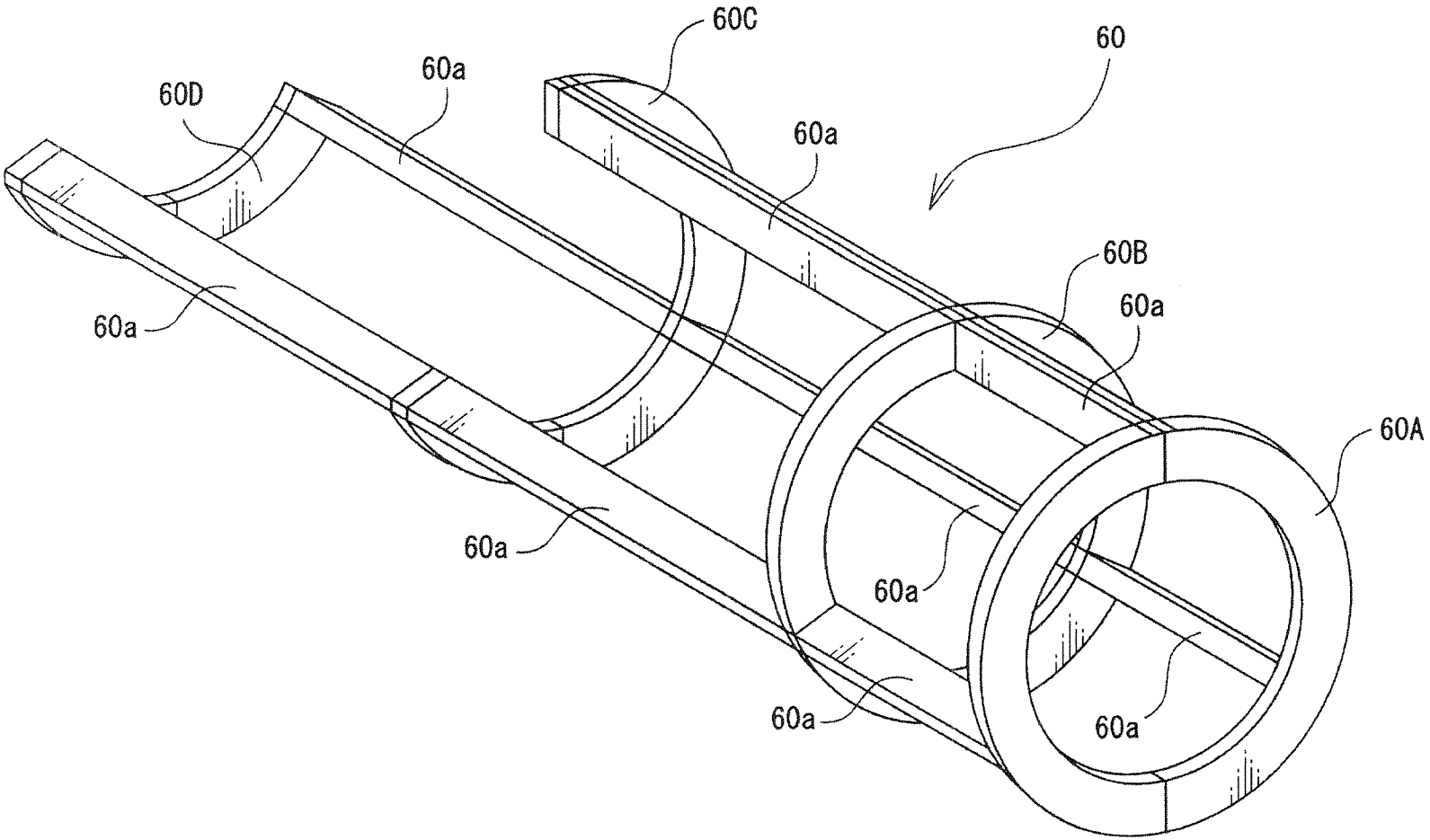
FIG. 21 is a perspective view showing a structure example of the ring-shaped shielding member.

FIG. 21 is a perspective view showing a structure example 2 of the ring-shaped shielding member 60 (the center core 58 is not shown). The shielding member 60 of the structure example 2 is a further development of the first structure example. In other words, in the structure example 2, the shielding member 60 includes a bored disk 60A at one end position in its longitudinal direction and a disk 60B of the same shape distanced from the disk 60A in the longitudinal direction. Following this disk 60B, a bored disk 60C having an about ⅔ circular cross section and distanced from the disk 60B in the longitudinal direction is disposed, and a bored disk 60D having an about ⅓ circular cross section is disposed at the other end position.

Out of these four disks 60A to 60D, three disks 60A, 60B and 60C are connected to each other via three straight portions 60*a*. The remaining disk 60D at the other end position is connected to the adjacent disk 60C via the two straight portions 60*a*.

In the case of employing this structure example 2, it is assumed that a plurality of magnetism adjusting members 90 are arranged one after another in the longitudinal direction (FIG. 7), i.e. the magnetism adjusting members 90 are arranged between the disks 60A and 60B, between the disks 60B and 60C and between the disks 60C and 60D.

Figure 22A:
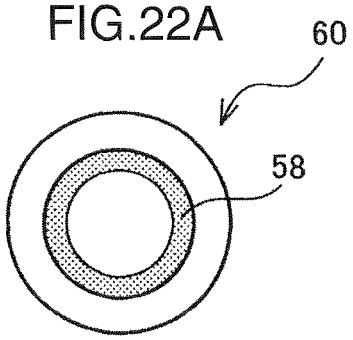
FIGS. 22A to 22D are diagrams showing a mounted state of the shielding member on the center core.
Figure 22A:
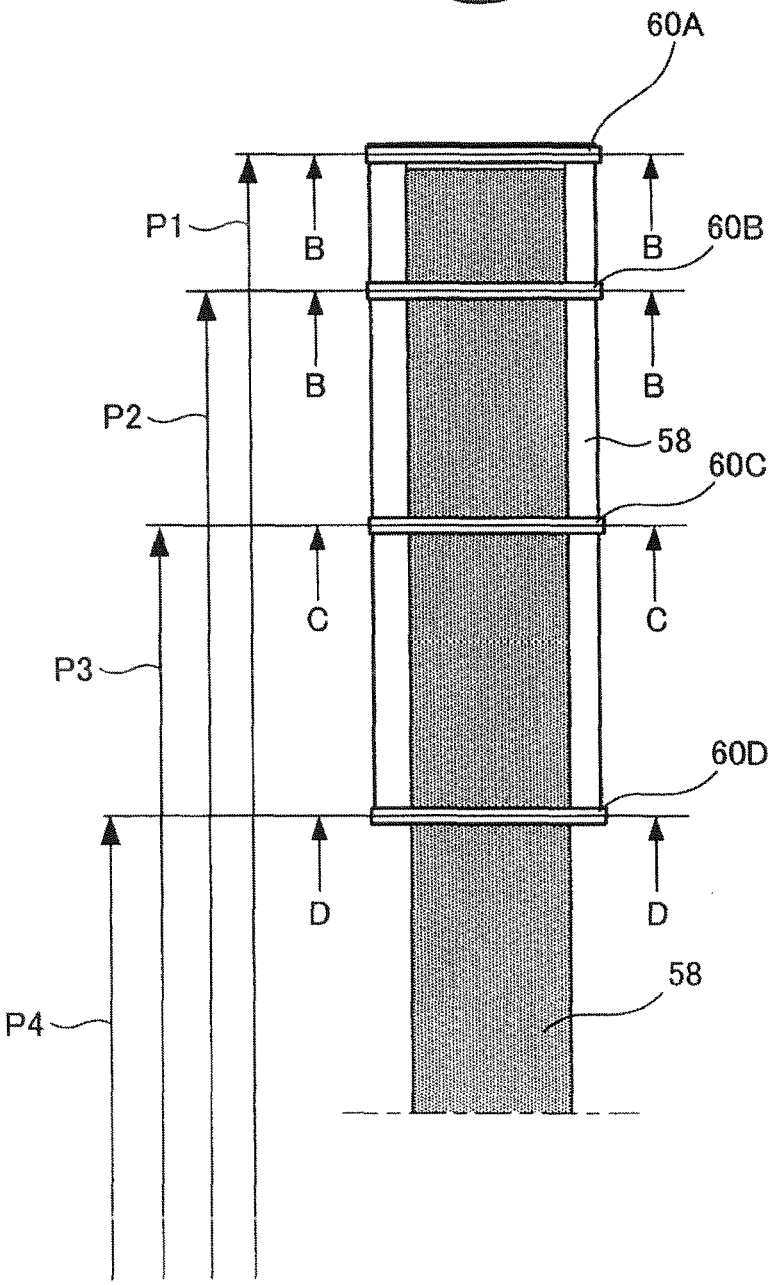
Figure 22B:
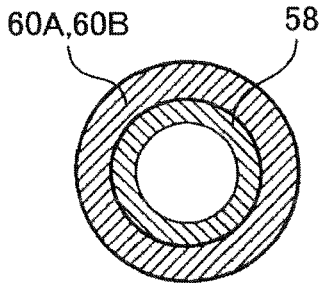
Figure 22C:
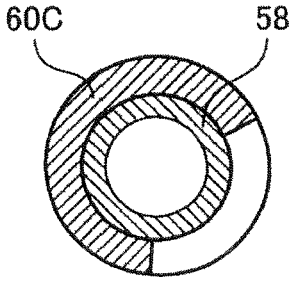
Figure 22D:
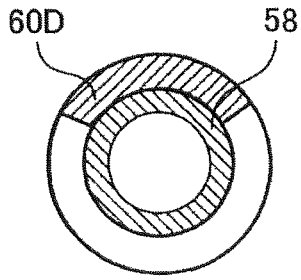

FIGS. 22A to 22D are diagrams showing a state where the shielding member 60 of the structure example 2 is mounted on the center core 58. FIG. 22A corresponds to a plan view and a side view of the center core 58 and FIGS. 22B, 22C and 22D are respectively sections along B-B, C-C and D-D of FIG. 22A.

As shown in FIG. 22A, the shielding member 60 of the structure example 2 is also provided at an end portion of the center core 58 in the longitudinal direction. At this time, the disk 60A most distant from the minimum sheet passage area is located at a position corresponding to a maximum size P1 (e.g. A3, A4R), the next disk 60B at a position corresponding to a medium size P2 (e.g. B4R) and the next disk 60C at a position corresponding to a medium-small size P3 (e.g. B4). The disk 60D near the minimum sheet passage area is located at a position corresponding to a minimum size P4 (e.g. A5R).

As shown in FIG. 22B, the disks 60A, 60B are understood to have bored shapes as described above. As shown in FIG. 22C, the disk 60C has a bored shape of about ⅔ circle as described above. As shown in FIG. 22D, the disk 60D has a bored shape of about ⅓ circle as described above.

[Operation Example of Structure Example 2]

Next, an operation example in the case of employing the shielding members 60 of the structure example 2 is described. FIGS. 23 to 28 are perspective views successively showing six operation examples in the case of employing the shielding member 60 of the structure example 2. Thick line arrow(s) shown in each of FIGS. 23 to 28 indicate(s) a generated induction current or a passing magnetic field. They are respectively described below.

[Full Shielding (0°)]

Figure 23:
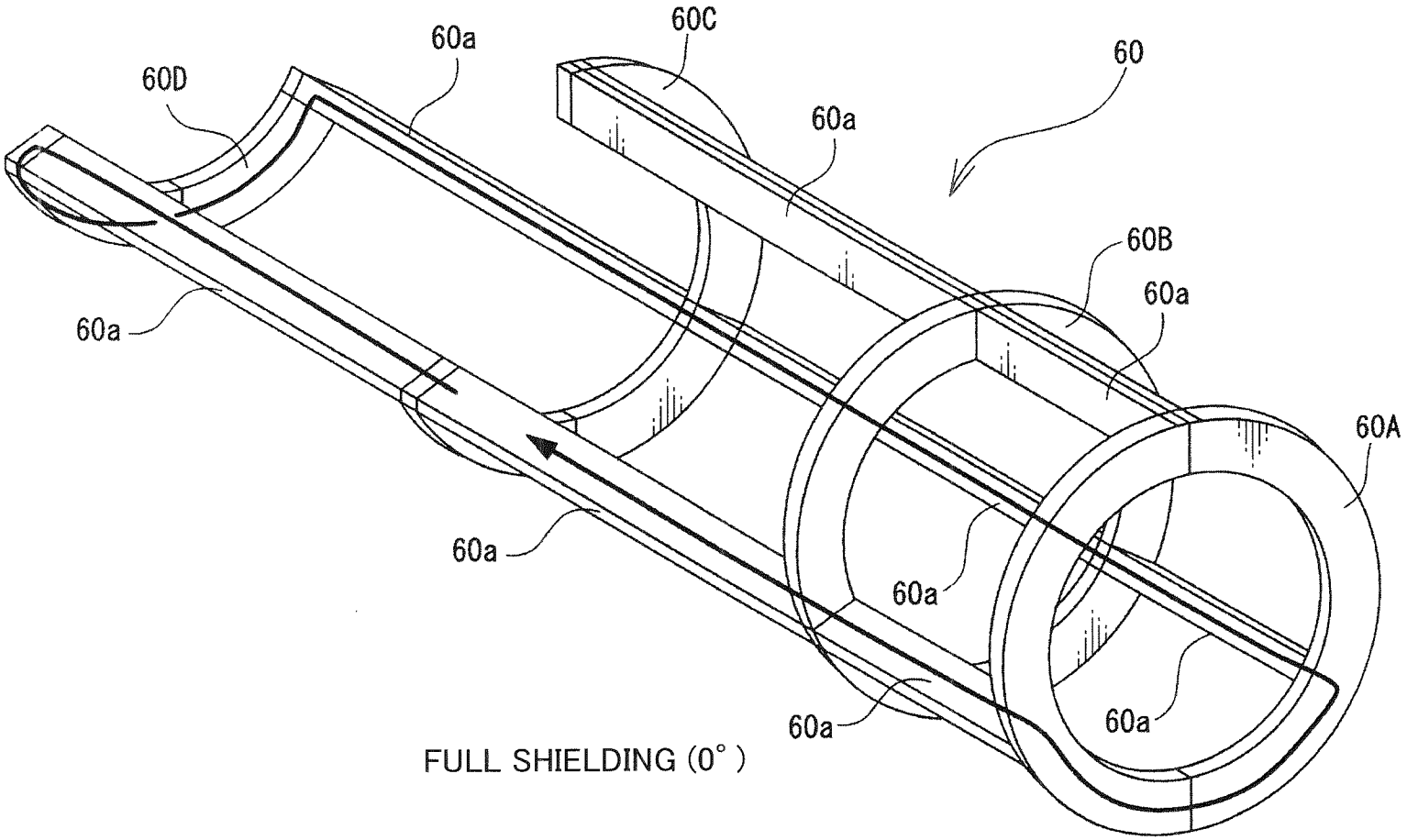
FIG. 23 is a perspective view showing an operation example in the case of full surface shielding (magnetic flux $\Phi 1=0$ in the entire surface) by the shielding member.

First of all, FIG. 23 is the perspective view showing an operation example in the case of full shielding (magnetic fluxes Φ1=0 in the entire surface) by the shielding member 60. It is assumed in each operation example that a magnetic field is generated in such a direction as to penetrate the shielding member 60 from upper side to lower side. In the following description, it is assumed that a state of full shielding shown in FIG. 23 is 0° and a displacement amount of the shielding member 60 is expressed by an angle of rotation from 0°.

If the shielding member 60 is moved to an angle of rotation (0°) at which the disk 60D is located at the bottom, the magnetic shielding effect (magnetic fluxes Φ1=0) can be exhibited by the entire surface of the shielding member 60 in the longitudinal direction. In other words, since a maximum ring part is formed by the disk 60A at the one end position, the disk 60D at the other end position and the straight portions 60A connecting these, the shielding member 60 can shield magnetism (magnetic fluxes Φ1=0) in its entirety.

In this case, the overheating of the heating belt 48 and the heat roller 46 can be prevented in correspondence with the minimum size P4 since the three magnetism adjusting members 90 shield magnetic fluxes in their entirety at each of the opposite ends.

[No Shielding (60°)]

Figure 24:
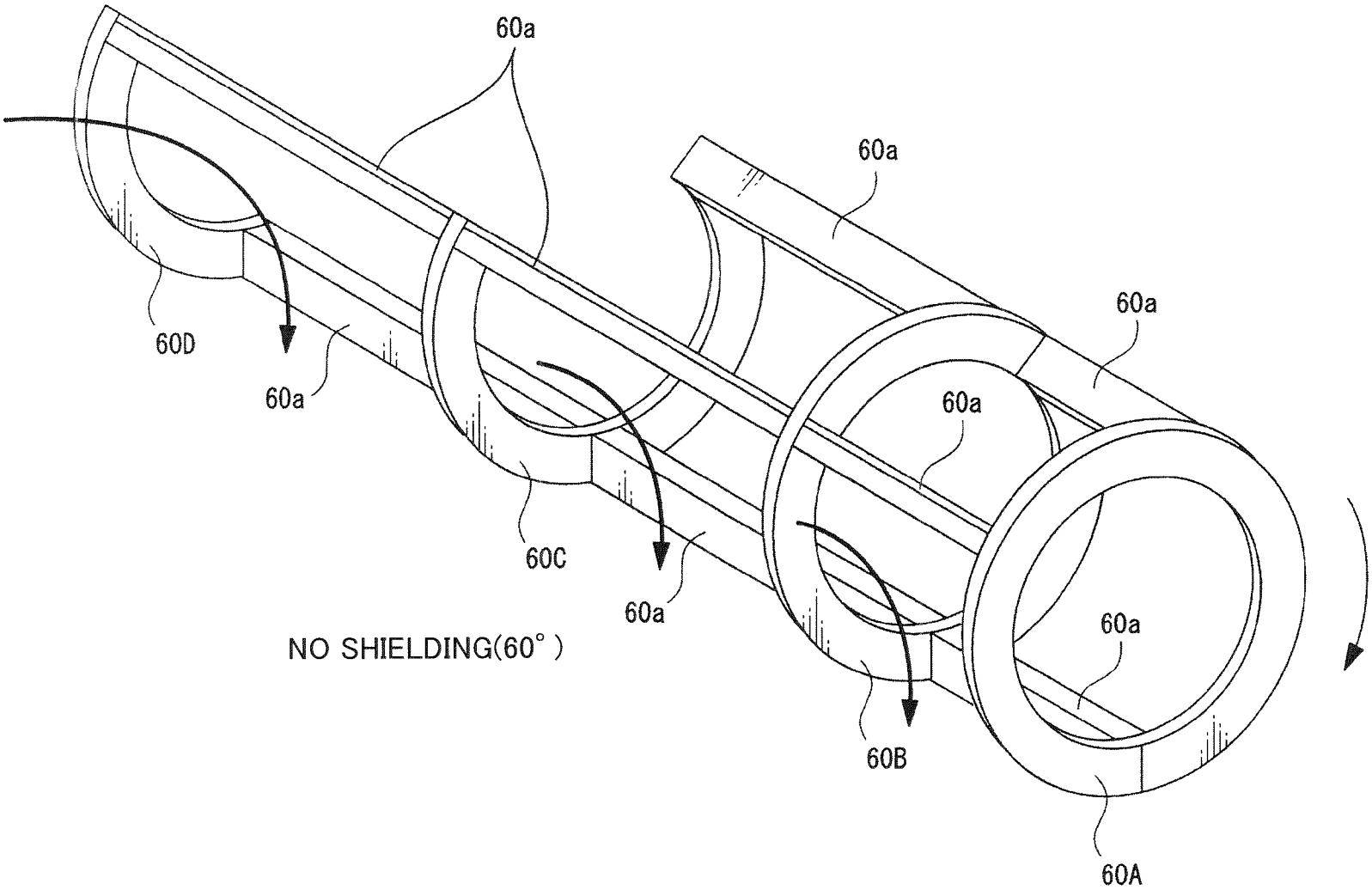
FIG. 24 is a perspective view showing an operation example at the time of rotating the shielding member by 60° in a clockwise direction in a state of FIG. 23.

FIG. 24 is the perspective view showing an operation example when the shielding member 60 is rotated in the clockwise direction by 60° from the state of FIG. 23. In this case, since the straight portion 60*a* is located on the center line of the coil 52 (state of FIG. 20A), the state switched to the first paths is set (the shielding member 60 is at the retracted position) and no magnetic shielding effect is exhibited.

[Intermediate-Small Size Shielding (120°)]

Figure 25:
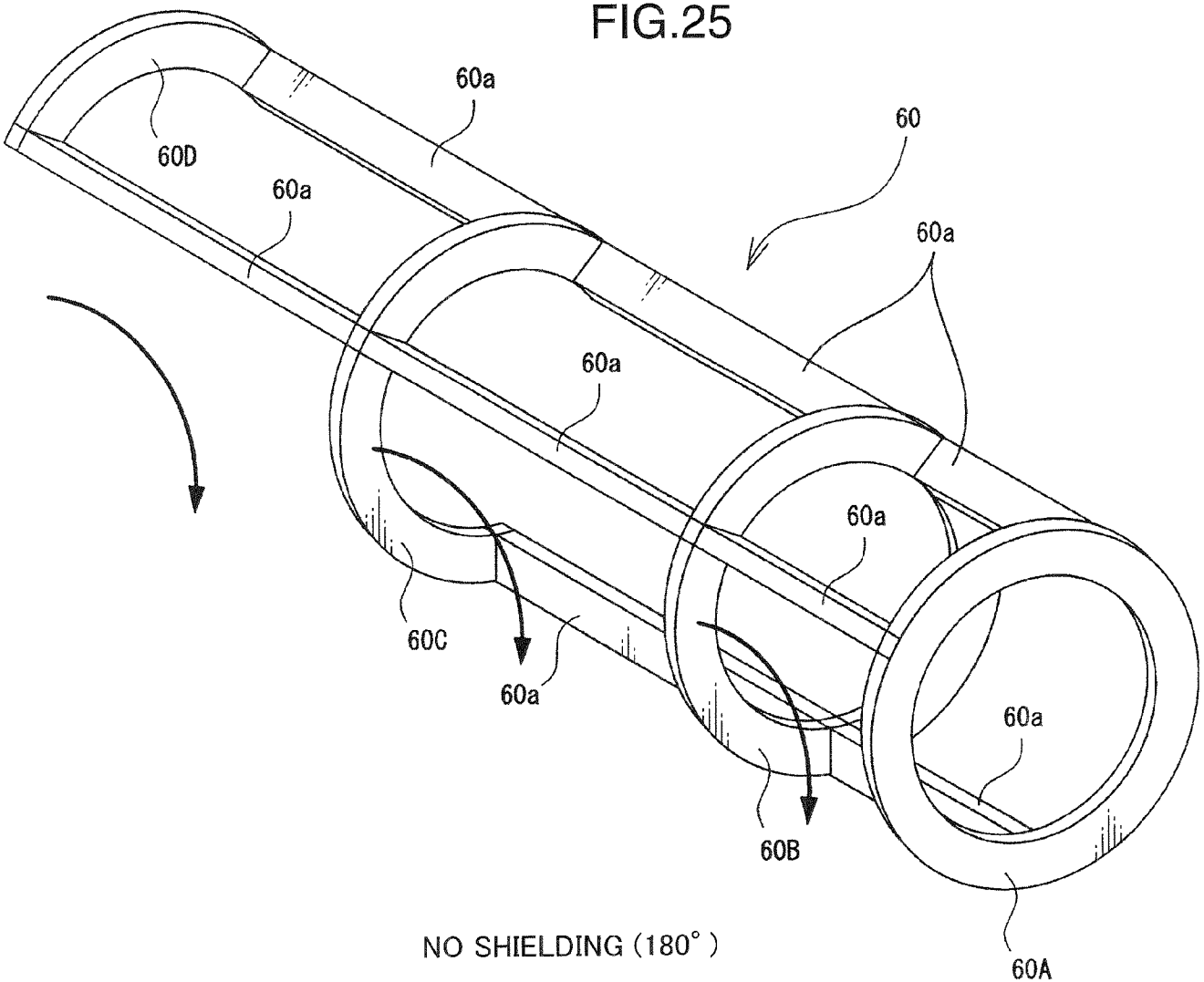
FIG. 25 is a perspective view showing an operation example at the time of rotating the shielding member by 120° in the clockwise direction in the state of FIG. 23.

FIG. 25 is the perspective view showing an operation example when the shielding member 60 is rotated in the clockwise direction by 120° from the state of FIG. 23. In this case, one ring part formed between the disks 60A and 60C can exhibit the magnetic shielding effect and the magnetic paths can be switched to the first paths only in one part in the longitudinal direction. In this operation example, the overheating of the heating belt 48 and the heat roller 46 can be prevented, for example, in correspondence with the medium-small size P3.

[No Shielding (180°)]

Figure 26:
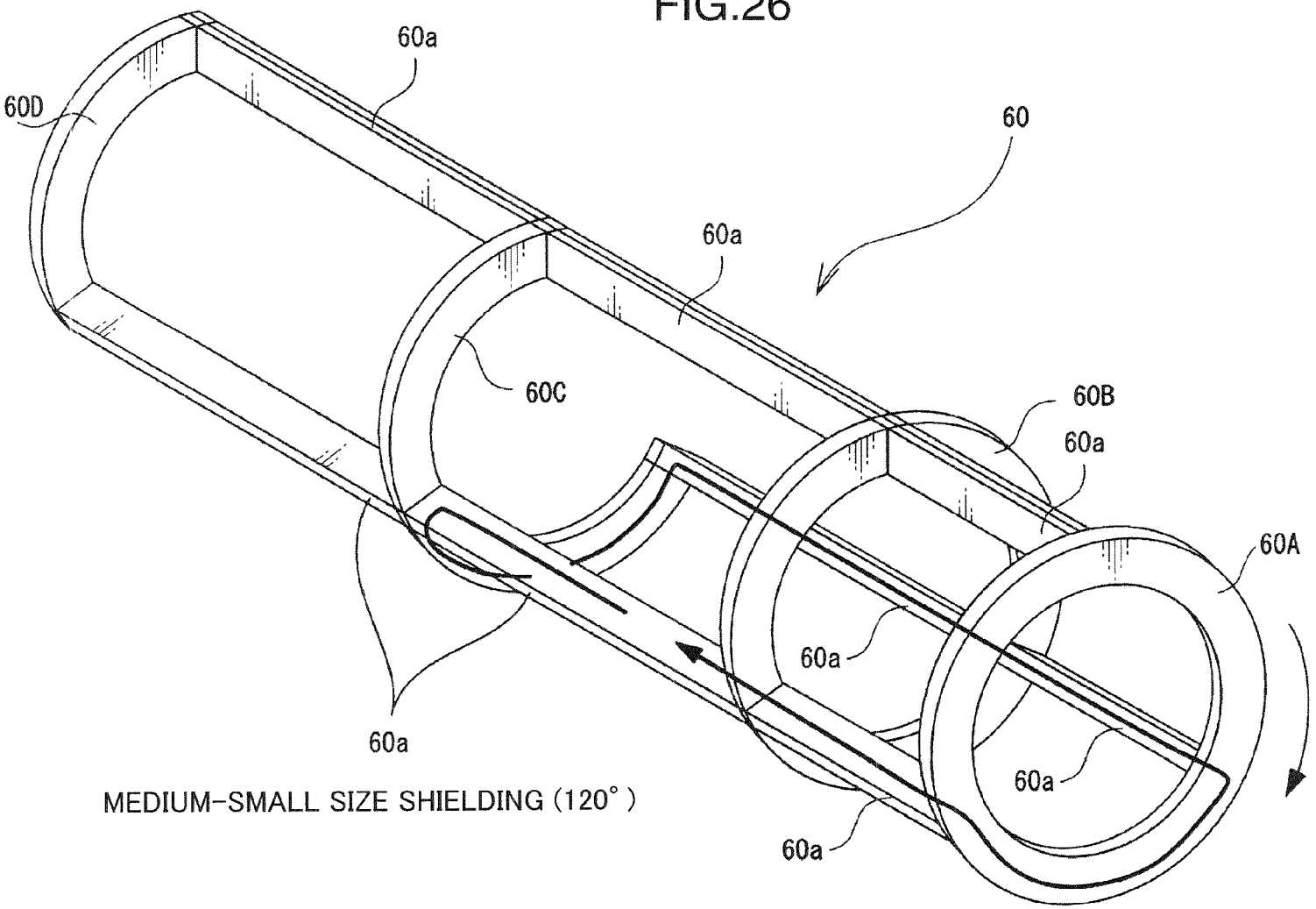
FIG. 26 is a perspective view showing an operation example at the time of rotating the shielding member by 180° in the clockwise direction in the state of FIG. 23.

FIG. 26 is the perspective view showing an operation example when the shielding member 60 is rotated in the clockwise direction by 180° from the state of FIG. 23. In this case, since the straight portion 60*a* is located on the center line of the coil 52 (state of FIG. 20A) as in FIG. 24, the state switched to the first paths is set (the shielding member 60 is at the retracted position) and no magnetic shielding effect is exhibited.

[Intermediate Size Shielding (240°)]

Figure 27:
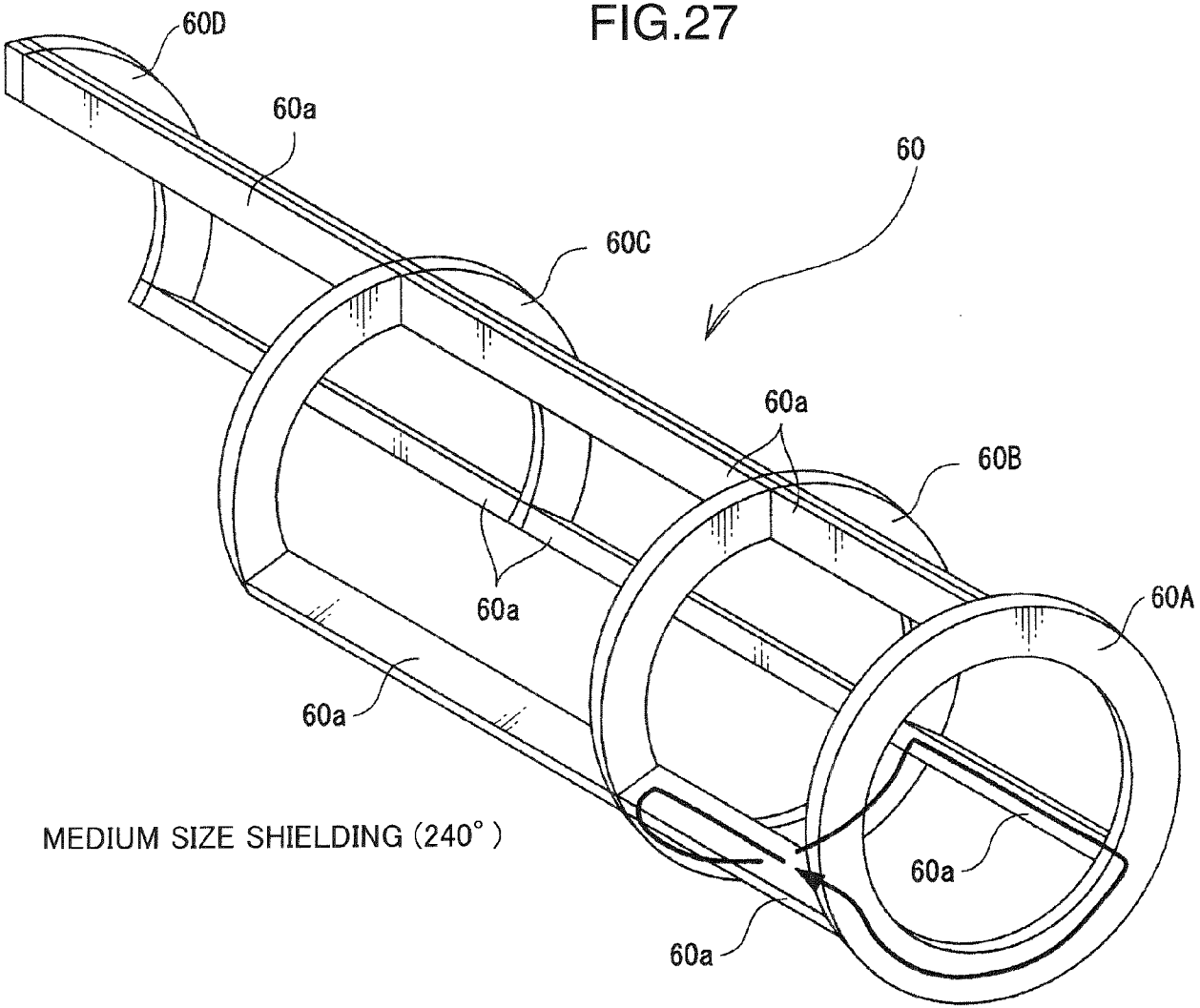
FIG. 27 is a perspective view showing an operation example at the time of rotating the shielding member by 240° in the clockwise direction in the state of FIG. 23.

FIG. 27 is the perspective view showing an operation example when the shielding member 60 is rotated in the clockwise direction by 240° from the state of FIG. 23. In this case, one ring part formed between the disks 60A and 60B can exhibit the magnetic shielding effect and the magnetic paths can be switched to the first paths only in one part in the longitudinal direction. In this operation example, the overheating of the heating belt 48 and the heat roller 46 can be prevented, for example, in correspondence with the medium size P2.

[No Shielding (300°)]

Figure 28:
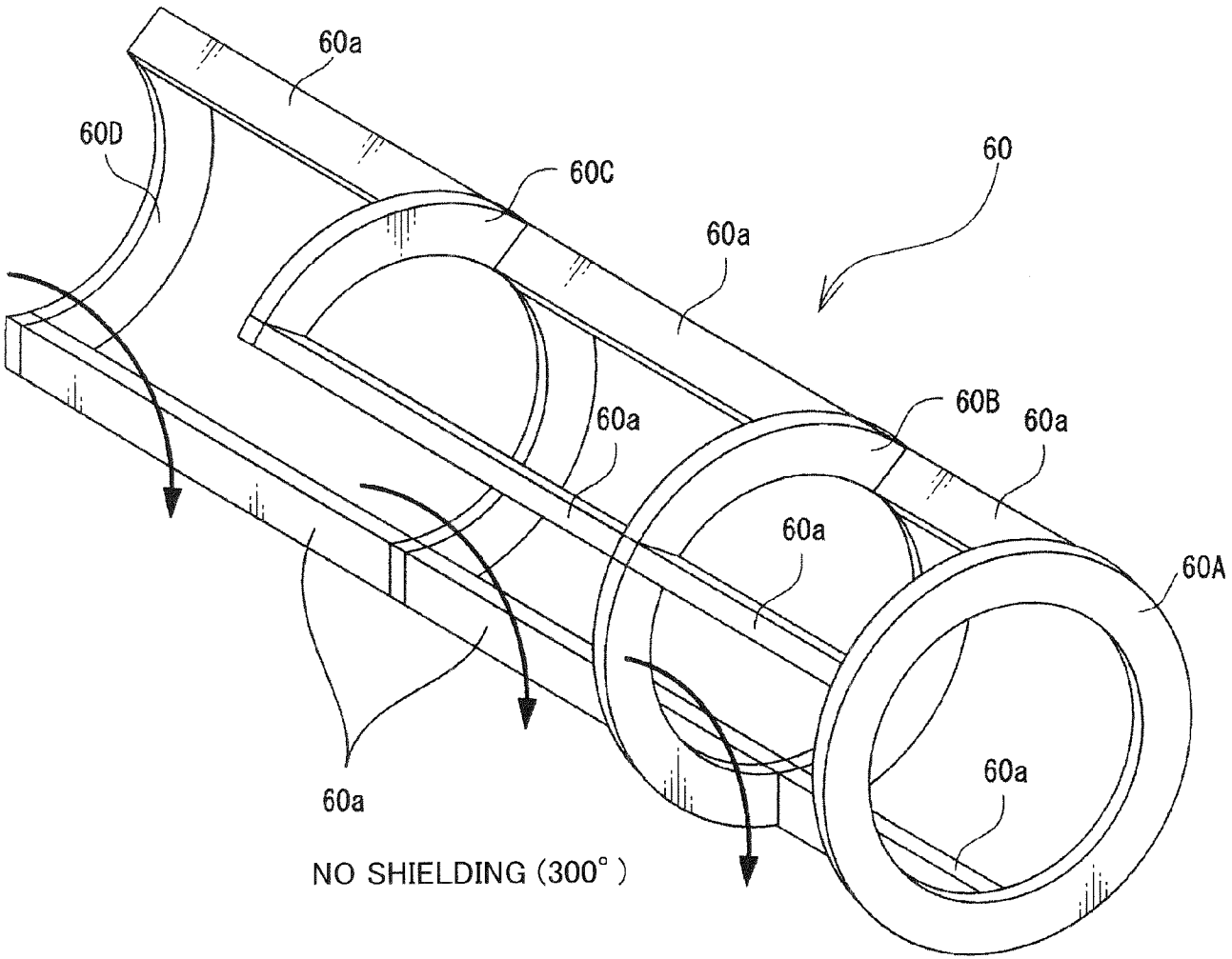
FIG. 28 is a perspective view showing an operation example at the time of rotating the shielding member by 300° in the clockwise direction in the state of FIG. 23.

FIG. 28 is the perspective view showing an operation example when the shielding member 60 is rotated in the clockwise direction by 300° from the state of FIG. 23. In this case, since the straight portion 60*a* is located on the center line of the coil 52 as in FIGS. 24 and 26 (state of FIG. 20A), the state switched to the first paths is set (the shielding member 60 is at the retracted position) and exhibits no magnetic shielding effect. In the case of no shielding) (60°), (180°) and (300°, the heating belt 48 and the heat roller 46 can be induction-heated in correspondence with the maximum size P1.

The present invention can be embodied in various modifications without being limited to the above embodiments. For example, the cross-sectional shape of the center core 58 is not limited to a tubular shape and may be a cylindrical shape or a polygonal shape. Further, the shape of the shielding member 60 in a plan view is not limited to a triangular shape and may be a trapezoidal shape.

Further, the shapes and sizes of the rings of the magnetism adjusting members 90, the number of the magnetism adjusting members 90 and the like described in the respective embodiments are merely examples and they are not particularly limited to one embodiment.

Besides, the specific shapes of the respective parts including the arch cores 54 and the side cores 56 are not limited to the shown ones and can be appropriately modified.

The image forming apparatus, particularly the fixing devices used in the image forming apparatus according to the above embodiments preferably have the following constructions.

An image forming apparatus preferably includes an image forming section for forming a toner image and transferring the toner image to a sheet; and a fixing device including a heating member and a pressing member and fixing the toner image to the sheet by conveying the sheet while holding the sheet between the heating member and the pressing member. The fixing device includes a coil arranged along the outer surface of the heating member for generating a magnetic field; a magnetic core arranged at a side of the coil opposite to the heating member and forming a magnetic path together with the heating member, (the magnetic path is composed of a first path for induction-heating a specified area of the heating member and a second path for induction-heating only a smaller area as a reduction of the specified area and the magnetic field is composed of a common magnetic field region where both the first and the second paths pass and an uncommon magnetic field region where only the first path passes); a path switching member for switching the magnetic path between the first path and the second path; and a magnetism adjusting member arranged at least over the uncommon magnetic field region and permitting the passage of magnetic fluxes propagating toward the heating member from the magnetic core in the uncommon magnetic field region when the magnetic path is switched to the first path by the path switching member while suppressing the passage of the magnetic fluxes in the uncommon magnetic field region when the magnetic path is switched to the second path by the path switching member.

In the image forming apparatus of the above construction, an excessive temperature increase of the heating member (body to be heated by electromagnetic induction) is basically suppressed by switching the magnetic path to the second path by the path switching member. Such a path switching member has a structural merit of not taking up a large space, but the inflow of the magnetic fluxes cannot be completely deterred only by switching the magnetic path and the above excessive temperature increase suppressing effect thereof is not perfect. Thus, such an effect is insufficient only by switching the magnetic path to the second path and higher productivity cannot be realized if this remains unchanged.

Accordingly, in the image forming apparatus, the fixedly arranged magnetism adjusting member is used in addition to the path switching member which is space-saving, but has a weak magnetic shielding effect. In other words, the magnetism adjusting member permits the passage of the magnetic fluxes in the entire magnetic field, i.e. in the common magnetic field region and the uncommon magnetic field region with the magnetic field switched to the first path, thereby maximizing a temperature increase effect, while blocking the passage of the magnetic fluxes in the uncommon magnetic field region with the magnetic field switched to the second path, thereby preventing an excessive temperature increase of the heating member.

In this way, heating contrast of the heating member at the time of switching to the first path and the second path can be intensified. Further, since the magnetism adjusting member has a function of permitting the passage of the magnetic fluxes and, conversely, shielding the magnetic fluxes (like a function of a magnetic filter) only by being located at a fixed position without being accompanied by any mechanical movement, it does not affect the magnetic field in the case of necessitating a temperature increase even if having a certain degree of area. Furthermore, since it is sufficient to fixedly arrange the magnetism adjusting member, it is not particularly necessary to provide a movable member anew and the fixing device can accordingly save space.

In the above image forming apparatus, it is preferable that the magnetism adjusting member includes a plurality of ring-shaped portions which are connected with each other while being adjacent in a direction intersecting with a propagation direction of the magnetic fluxes; that the plurality of ring-shaped portions are structured such that induction currents generated by the magnetic fluxes penetrating through the plurality of ring-shaped portions flow in opposite directions in the adjacent ring-shaped portions when the magnetic path is switched to the first path by the path switching member; and that the path switching member reduces the amount of the magnetic fluxes penetrating through some of the plurality of ring-shaped portions when the magnetic path is switched to the second path.

According to the above construction, for example, if the magnetism adjusting member includes at least two ring-shaped portions, these two ring-shaped portions are connected in a so-called figure of 8 shape. In other words, in this case, if the magnetic fluxes penetrate through the adjacent two ring-shaped portions in the same direction, the direction of an induction current generated in one ring-shaped portion and that of an induction current generated in the other ring-shaped portion are opposite, whereby the induction currents are canceled out as a whole in the magnetism adjusting member. In this case, since the magnetism adjusting member hardly affects the magnetic field, the passage of the magnetic fluxes can be permitted without any problem.

In contrast, upon the switch to the second path, the amount of the magnetic fluxes penetrating through either one of the ring-shaped portions decreases (becomes almost 0), whereby an induction current is generated in the other ring-shaped portion and generates magnetic fluxes (demagnetizing field) of a direction opposite to the penetrating magnetic fluxes. In this case, the magnetic fluxes trying to pass along the second path are shielded, with the result that the magnetism adjusting member can exhibit a magnetic flux shielding effect in its entirety.

The plurality of ring-shaped portions are preferably formed by twisting a simple ring made of a wire material with a good conductive property in different directions at a plurality of positions.

In the above image forming apparatus, it is preferable that some of the plurality of ring-shaped portions are preferably arranged on the first path; and that other ring-shaped portions adjacent to the some ring-shaped portions are arranged on the second path.

With the above arrangement, a first induction current generated in one ring-shaped portion by magnetic fluxes passing along the first path and a second induction current generated by the passage of magnetic fluxes trying to pass along the second path while deviating from the first path through the other adjacent ring-shaped portion cancel each other with the magnetic path switched to the first path by the path switching member. In this way, the magnetism adjusting member permits the passage of not only the magnetic fluxes trying to pass along the first path, but also the magnetic fluxes trying to pass along the second path while deviating from the first path, with the result that the passage of the magnetic fluxes can be permitted in the entire switching region.

On the other hand, when the magnetic path is switched to the second path by the path switching member, almost no magnetic fluxes pass through one ring-shaped portion and the magnetic fluxes pass only through the other adjacent ring-shaped portion to generate an induction current. At this time, the magnetic fluxes generated in the other ring-shaped portion cancels the magnetic fluxes trying to pass along the second path, with the result that the magnetism adjusting member can shield the magnetic fluxes in the entire switching region.

In the above image forming apparatus, it is preferable that the magnetic core includes a pair of first cores arranged at the opposite sides of the winding center of the coil and a second core arranged between the first cores for forming the magnetic path reaching the heating member via the winding center of the coil; that the path switching member permits the passage of the magnetic fluxes from the second core to the heating member via the winding center of the coil upon switching the magnetic path to the first path and, on the other hand, permits the passage of the magnetic fluxes from the first cores to the heating member at a position deviated from the winding center of the coil upon switching the magnetic path to the second path; and that some of the plurality of ring-shaped portions of the magnetism adjusting member are arranged on the first path passing through the winding center of the coil and the other ring-shaped portions thereof are arranged on the second path at the opposite sides of the some ring-shaped portions.

In the above construction, it is preferable that one ring-shaped portion is arranged on the first path passing through the winding center of the coil; and that two ring-shaped portions are arranged on the second paths at the opposite sides of the one ring-shaped portion.

According to the above construction, the magnetism adjusting member is so structured as to include one ring-shaped portion in the center and two ring-shaped portions at the opposite sides of the one ring-shaped portion. The central ring-shaped portion is arranged on an extension of the winding center of the coil and the other ring-shaped portions are arranged at the opposite sides of the central ring-shaped portion.

With the magnetic path switched to the first path by the path switching member, a first induction current generated in the one central ring-shaped portion by the magnetic fluxes passing along the first path and second induction currents generated by the passage of the magnetic fluxes, which are trying to pass along the second paths located at the opposite sides of the first path while deviating from the first path, through the other adjacent two ring-shaped portions cancel each other. In this way, the magnetism adjusting member permits the passage of not only the magnetic fluxes trying to pass along the first path, but also the magnetic fluxes trying to pass along the second paths while deviating from the first path, with the result that the passage of the magnetic fluxes can be permitted in the entire magnetic field.

On the other hand, when the magnetic path is switched to the second path by the path switching member, almost no magnetic fluxes pass through the one central ring-shaped portion and the magnetic fluxes pass only through the other adjacent two ring-shaped portions to generate induction currents. At this time, the magnetic fluxes generated in the other two ring-shaped portions cancel the magnetic fluxes trying to pass along the second path, with the result that the magnetism adjusting member can shield the magnetic fluxes in the uncommon magnetic field region. Further, since the magnetic flux shielding effect can be exhibited by the two ring-shaped portions arranged at the opposite sides of the one central ring-shaped portion only by suppressing the passage of the magnetic fluxes through the one ring-shaped portion arranged in the center, the shielding effect can be efficiently obtained by a simple structure.

In the image forming apparatus of the above construction, it is preferable that the heating member is induction-heated by the coil in a maximum sheet passage area in a sheet width direction orthogonal to a sheet conveying direction; and that the magnetism adjusting member is arranged outside a sheet passage area having a width smaller than a maximum width of sheets corresponding to the maximum sheet passage area in a longitudinal direction of the heating member extending in the sheet width direction.

According to the above construction, an end portion of the heating member which becomes a sheet non-passage area depending on the sheet size can be satisfactorily protected from an excessive temperature increase.

In the image forming apparatus of the above construction, a plurality of magnetism adjusting members are arranged in the longitudinal direction of the heating member in accordance with a plurality of sheet sizes.

According to the above construction, if there are a plurality of different sheet sizes, ranges capable of suppressing heat generation can be set stepwise in the longitudinal direction of the heating member by selecting the magnetism adjusting members for shielding the magnetic fluxes according to the respective sizes.

In the image forming apparatus of the above construction, it is preferable that the second core has a tubular sectional shape and is rotatable about an axial line thereof; that the path switching member is a plate-like shielding member made of a nonmagnetic material with a good conductive property and mounted on the outer peripheral surface of the second core; and that the magnetic path is switched to the first path by rotating the second core to move the shielding member to a position deviated from the magnetic path while being switched to the second path by rotating the second core to move the shielding member to the magnetic path.

In the image forming apparatus of the above construction, a covering ratio preferably differs in a sheet width direction orthogonal to a sheet conveying direction when the covering ratio is a ratio of the length of the shielding member to the outer circumferential length of the second core in a rotating direction of the second core. In this case, the covering ratio preferably increases toward an outer side in the sheet width direction.

According to this construction, excessive temperature increases at the opposite end parts of the heating member can be prevented by decreasing a magnetic shielding amount as the sheet size increases while, conversely increasing the magnetic shielding amount as the sheet size decreases.

In the image forming apparatus of the above construction, it is preferable that the path switching member includes a ring-shaped frame made of a nonmagnetic metal and a ring surface defined by the frame; and that the magnetic path is switched between the first path and the second path by switching the position of the ring surface with respect to the magnetic path.

This application is based on Japanese Patent Application Serial No. 2008-276677 filed in Japan Patent Office on Oct. 28, 2008, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

an image forming section for forming a toner image and transferring the toner image to a sheet; and a fixing device including a heating member and a pressing member and fixing the toner image to the sheet by conveying the sheet while holding the sheet between the heating member and the pressing member, wherein the fixing device includes:

a coil arranged along the outer surface of the heating member for generating a magnetic field;

a magnetic core arranged at a side of the coil opposite to the heating member and forming a magnetic path together with the heating member, the magnetic path being composed of a first path for induction-heating a specified area of the heating member and a second path for induction-heating only a smaller area as a reduction of the specified area and the magnetic field being composed of a common magnetic field region where both the first and the second paths pass and an uncommon magnetic field region where only the first path passes;

a path switching member for switching the magnetic path between the first path and the second path; and a magnetism adjusting member separate from the path switching member and arranged at least over the uncommon magnetic field region with a clearance between the magnetism adjusting member and the path switching member, the magnetism adjusting member permitting the passage of magnetic fluxes propagating toward the heating member from the magnetic core in the uncommon magnetic field region when the magnetic path is switched to the first path by the path switching member while suppressing the passage of the magnetic fluxes in the uncommon magnetic field region when the magnetic path is switched to the second path by the path switching member.

2. The image forming apparatus of claim 1, wherein:

the magnetism adjusting member includes a plurality of ring-shaped portions which are connected with each other while being adjacent in a direction intersecting with a propagation direction of the magnetic fluxes;

the plurality of ring-shaped portions are structured such that induction currents generated by the magnetic fluxes penetrating through the plurality of ring-shaped portions flow in opposite directions in the adjacent ring-shaped portions when the magnetic path is switched to the first path by the path switching member; and the path switching member reduces the amount of the magnetic fluxes penetrating through some of the plurality of ring-shaped portions when the magnetic path is switched to the second path.

3. The image forming apparatus of claim 2, wherein the plurality of ring-shaped portions are formed by twisting a simple ring made of a wire material with a good conductive property in different directions at a plurality of positions.

4. The image forming apparatus of claim 2, wherein some of the plurality of ring-shaped portions are arranged on the first path, whereas other ring-shaped portions adjacent to the some ring-shaped portions are arranged on the second path.

5. The image forming apparatus of claim 2, wherein:

the magnetic core includes a pair of first cores arranged at the opposite sides of the winding center of the coil and a second core arranged between the first cores for forming the magnetic path reaching the heating member via the winding center of the coil;

the path switching member permits the passage of the magnetic fluxes from the second core to the heating member via the winding center of the coil upon switching the magnetic path to the first path and, on the other hand, permits the passage of the magnetic fluxes from the first cores to the heating member at a position deviated from the winding center of the coil upon switching the magnetic path to the second path; and some of the plurality of ring-shaped portions of the magnetism adjusting member are arranged on the first path passing through the winding center of the coil and the other ring-shaped portions thereof are arranged on the second path at the opposite sides of the some ring-shaped portions.

6. The image forming apparatus of claim 5, wherein one ring-shaped portion is arranged on the first path passing through the winding center of the coil, whereas two ring-shaped portions are arranged on the second paths at the opposite sides of the one ring-shaped portion.

7. The image forming apparatus of claim 5, wherein:

the second core has a tubular sectional shape and is rotatable about an axial line thereof;

the path switching member is a plate-like shielding member made of a nonmagnetic material with a good conductive property and mounted on the outer peripheral surface of the second core; and the magnetic path is switched to the first path by rotating the second core to move the shielding member to a position deviated from the magnetic path while being switched to the second path by rotating the second core to move the shielding member to the magnetic path.

8. The image forming apparatus of claim 7, wherein a covering ratio differs in a sheet width direction orthogonal to a sheet conveying direction when the covering ratio is a ratio of the length of the shielding member to the outer circumferential length of the second core in a rotating direction of the second core.

9. The image forming apparatus of claim 8, wherein the covering ratio increases toward an outer side in the sheet width direction.

10. The image forming apparatus of claim 1, wherein:

the heating member is induction-heated by the coil in a maximum sheet passage area in a sheet width direction orthogonal to a sheet conveying direction; and the magnetism adjusting member is arranged outside a sheet passage area having a width smaller than a maximum width of sheets corresponding to the maximum sheet passage area in a longitudinal direction of the heating member extending in the sheet width direction.

11. The image forming apparatus of claim 10, wherein a plurality of magnetism adjusting members are arranged in the longitudinal direction of the heating member in accordance with a plurality of sheet sizes.

12. The image forming apparatus of claim 1, wherein:

the path switching member includes a ring-shaped frame made of a nonmagnetic metal and a ring surface defined by the ring-shaped frame; and the magnetic path is switched between the first path and the second path by switching the position of the ring surface with respect to the magnetic path.

* * * * *